US006689548B2

(12) United States Patent
Yamashita et al.

(10) Patent No.: US 6,689,548 B2
(45) Date of Patent: Feb. 10, 2004

(54) SILVER SALT PHOTOTHERMOGRAPHIC DRY IMAGING MATERIAL, AN IMAGE RECORDING METHOD AND AN IMAGE FORMING METHOD

(75) Inventors: Hirobumi Yamashita, Tokyo (JP); Toshihisa Takeyama, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/217,001

(22) Filed: Aug. 12, 2002

(65) Prior Publication Data

US 2003/0118955 A1 Jun. 26, 2003

(30) Foreign Application Priority Data

Aug. 20, 2001 (JP) ..... 2001-248893

(51) Int. Cl.[7] ..... G03C 1/498; G03C 1/30; G03C 5/16

(52) U.S. Cl. ..... 430/350; 430/523; 430/600; 430/603; 430/607; 430/619; 430/621; 430/622; 430/631; 430/945

(58) Field of Search ..... 430/619, 631, 430/523, 620, 600, 621, 603, 622, 607, 350, 21, 945

(56) References Cited

U.S. PATENT DOCUMENTS

| | | | | | |
|---|---|---|---|---|---|
| 3,615,526 | A | | 10/1971 | Huckstadt et al. | |
| 6,232,059 | B1 | * | 5/2001 | Yamada et al. | 430/619 |
| 6,461,805 | B1 | * | 10/2002 | Habu et al. | 430/619 |
| 6,492,102 | B1 | * | 12/2002 | Kagawa et al. | 430/584 |
| 2003/0044738 | A1 | * | 3/2003 | Takeyama | 430/620 |

FOREIGN PATENT DOCUMENTS

| | | | | |
|---|---|---|---|---|
| EP | 1136877 | * | 3/2001 | G03C/1/498 |
| EP | 1 122 593 A2 | | 8/2001 | |
| EP | 1 271 235 A1 | | 1/2003 | |
| JP | 2002-023304 | * | 1/2002 | G03C/1/498 |

OTHER PUBLICATIONS

Database WPI, Section Ch, Week 199645, Derwent Publications Ltd., London, GB; AN 1996–446814, XP002239100 of JP 08 220673 A (Konica Corp.), Aug. 30, 1996.

* cited by examiner

*Primary Examiner*—Thorl Chea
(74) *Attorney, Agent, or Firm*—Frishauf, Holtz, Goodman & Chick, P.C.

(57) ABSTRACT

A photothermographic imaging material comprising a support having thereon a photosensitive layer, wherein the photosensitive layer has a silver coverage of 0.8 to 2.5 g/m$^2$ and comprises a compound represented by Formula (A) or Formula (B):

Formula (A), wherein each $R^3$, $R^4$ and $R^5$ is independently an alkyl group, an alkenyl group, an alkynyl group, an aryl group or a heterocyclic group, provided that $R^5$ includes a silyl containing group, Formula (B), wherein $Z^2$ represents $OR^{22}$, $X^2$, or OH; $n^2$ is an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two selected from the group consisting of primary and secondary amino groups; and X is a chlorine atom or a bromine atom.

13 Claims, No Drawings

SILVER SALT PHOTOTHERMOGRAPHIC DRY IMAGING MATERIAL, AN IMAGE RECORDING METHOD AND AN IMAGE FORMING METHOD

FIELD OF THE INVENTION

The present invention relates to a silver salt photothermographic dry imaging material, and an image recording method and an image forming method by the use thereof.

BACKGROUND OF THE INVENTION

Heretofore, in the medical and printing plate making fields, effluent resulting from wet type processing for image forming materials has become problematic in terms of workability. In recent years, from the viewpoint of environmental protection as well as space saving, a decrease in processing effluent has been highly demanded. Accordingly, there have been demanded techniques regarding photothermographic materials. These materials can be efficiently exposed utilizing laser imagers and image setters, and can form clear black-and-white images with a high resolution.

Examples of these techniques are described in U.S. Pat. Nos. 3,152,904 and 3,487,075, as well as in D. Morgan and B. Shely, "Thermally Processed Silver Systems", (Image Processes and Materials, Neblette 8th edition, edited by Sturge, V. Walworth and A. Shepp, page 2, 1969). In these references have been disclosed silver salt photothermographic dry imaging materials that produce photographic images by employing a thermal development process.

These silver salt photothermographic dry imaging materials (hereafter it is also called "photothermographic imaging materials") are characterized by a photosensitive layer that forms images by thermal development commonly at 80 to 140° C. In the photosensitive layer, an organic silver salt is used as a source of silver ions by utilizing an incorporated reducing agent and photosensitive silver halide grains as a photo-sensor. This image forming process does not comprise a fixing process. Much effort has been directed toward improvement of shapes of organic silver salt particles that can be easily and properly allocated in a photosensitive layer and have less adverse influence by light scattering. These shapes are expected to supply silver ions with smooth progress to silver halides, and at the same time to prevent the resulting image from decreasing transparency by light scattering in said photosensitive layer.

For the above-mentioned objects, however, an attempt to simply make particles smaller in size by dispersion or cracking with high mechanical energy using a disperser, causes problems of raised fog and lowered sensitivity. Further, this results in deteriorated image quality. These problems occur as a result of damaging said silver halide particles and organic silver salt particles. Accordingly, techniques to obtain high sensitivity and high image density without increasing an amount of silver, and also lowering fog density, are required.

A silane coupling agent is generally employed to enhance the strength of FRP (fiber glass reinforced plastics). In recent years, it has been widely employed due to its effect of adhesive properties of boundary surfaces of inorganic materials and organic resins, and thus, it is well known that said silane coupling agents are employed as hardeners for silver salt photothermographic dry imaging materials, as described in U.S. Pat. Nos. 4,886,739, 5,264,334 and 5,294,526.

The inventors of the present invention, however, have found that specific silyl compounds show distinguished effects of yielding high maximum density, high sensitivity and lowered fog when employed in photothermographic imaging materials.

SUMMARY OF THE INVENTION

An object of the present invention is to provide a silver salt photothermographic dry imaging material that exhibits high maximum density and minimizes fog, and also to provide an image recording method and an image forming method, herein, both of which use said silver salt photothermographic dry imaging material.

The object of the invention can be achieved by the following embodiments.

1. A photothermographic imaging material comprising a support having thereon a photosensitive layer comprising a photosensitive silver halide, a light-insensitive organic silver salt, a binder and a reducing agent for silver ions, wherein the photosensitive layer has a silver coverage of 0.8 to 2.5 g/m$^2$, and the photosensitive layer comprises a compound represented by Formula (A) or Formula (B):

Formula (A),

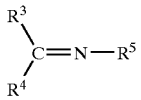

wherein each $R^3$, $R^4$ and $R^5$ is independently an alkyl group, an alkenyl group, an alkynyl group, an aryl group or a heterocyclic group, provided that $R^5$ includes a group represented by Formula (α):

Formula (α),

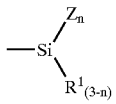

wherein Z represents $OR^2$, X, or OH; n is an integer of 1 to 3; each $R^1$ and $R^2$ is independently an alkyl group, an alkenyl group, an alkynyl group, an aryl group or a heterocyclic group; and X is a chlorine atom or a bromine atom, Formula (B),

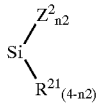

wherein $Z^2$ is $OR^{22}$, $X^2$, or OH; $n^2$ is an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two selected from the group consisting of primary and secondary amino groups; and X is a chlorine atom or a bromine atom.

2. The photothermographic imaging material of item 1, wherein the photosensitive layer has a silver coverage of 0.8 to 1.6 g/m$^2$.

3. A photothermographic imaging material comprising a support having thereon a photosensitive layer comprising a photosensitive silver halide, a light-insensitive organic silver salt, a binder and a reducing agent for silver ions, wherein the photosensitive silver halide has an average particle size of 0.01 to 0.15 μm, and the photosensitive layer comprises a compound represented by Formula (A) or Formula (B):

Formula (A),

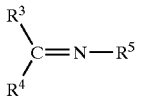

wherein each $R^3$, $R^4$ and $R^5$ is independently an alkyl group, an alkenyl group, an alkynyl group, an aryl group or a heterocyclic group, provided that $R^5$ includes a group represented by Formula (α):

Formula (α),

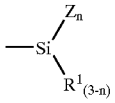

wherein Z is $OR^2$, X, or OH; n is an integer of 1 to 3; each $R^1$ and $R^2$ is independently an alkyl group, an alkenyl group, an alkynyl group, an aryl group or a heterocyclic group, and X is a chlorine atom or a bromine atom, Formula (B),

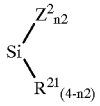

wherein $Z^2$ is $OR^{22}$, $X^2$, or OH; $n^2$ represents an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two selected from the group consisting of primary and secondary amino groups; and X represents a chlorine atom or a bromine atom.

4. The photothermographic imaging material of item 3, wherein the photosensitive silver halide has an average particle size of 0.03 to 0.10 μm.

5. A photothermographic imaging material comprising a support having thereon a photosensitive layer comprising a photosensitive silver halide, a light-insensitive organic silver salt, a reducing agent for silver ions and a binder, wherein the photosensitive layer comprises a compound represented by Formula (A) or Formula (B) and the photosensitive layer further comprises a compound represented by Formula (1):

Formula (A),

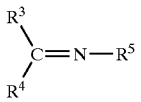

wherein each $R^3$, $R^4$ and $R^5$ is independently an alkyl group, an alkenyl group, an alkynyl group, an aryl group or a heterocyclic group, provided that $R^5$ includes a group represented by Formula (α):

Formula (α),

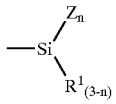

wherein Z represents $OR^2$, X, or OH; n is an integer of 1 to 3; each $R^1$ and $R^2$ is independently an alkyl group, an alkenyl group, an alkynyl group, an aryl group or a heterocyclic group; and X is a chlorine atom or a bromine atom, Formula (B),

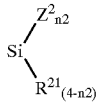

wherein $Z^2$ represents $OR^{22}$, $X^2$, or OH; $n^2$ is an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two selected from the group consisting of primary and secondary amino groups; and X is a chlorine atom or a bromine atom Formula (1),

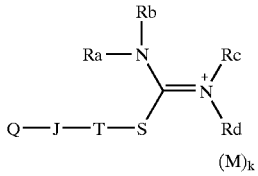

wherein Q represents an aryl group or an aromatic heterocyclic group; T represents a single bond or a bivalent aliphatic linking group; J represents a linking group containing at least one of O, S, and N; each Ra, Rb, Rc and Rd independently represents H, an acyl group, an aliphatic group, an aryl group or a heterocyclic group, provided that Ra and Rb, Rc and Rd, Ra and Rc, or Rb and Rd may combine to form a nitrogen containing heterocyclic group; M is an ion; and k is an integer necessary to neutralize a charge.

6. The photothermographic imaging material of item 1, wherein Z in Formula (B) represents $OR^{21}$, $R^{21}$ containing at least two selected from the group consisting of primary and secondary amino groups.

7. An image recording method, comprising a step of:

exposing the photothermographic imaging material of item 1 with a laser beam using a laser scanning exposure apparatus, wherein the photothermographic imaging material is exposed not substantially vertical to a surface of the photothermographic imaging material.

8. An image recording method, comprising a step of:

exposing the photothermographic imaging material of item 1 with a laser beam using a laser scanning exposure apparatus, wherein the photothermographic imaging material is exposed using a longitudinal multiple scanning method.

9. An image recording method, comprising a step of:

exposing the photothermographic imaging material of item 1 with a laser beam using a laser scanning exposure apparatus, wherein the photothermographic imaging material is exposed not substantially vertical to a surface of the photothermographic imaging material using a longitudinal multiple scanning method.

10. An image forming method, comprising the steps of:

(a) exposing the photothermographic imaging material of item 1 with a light using an exposure apparatus; and then (b) subjecting the photothermographic imaging material to thermal development at a temperature of 80 to 200° C.

11. An image forming method, comprising the steps of:

(a) exposing the photothermographic imaging material of item 1 with a laser beam using a laser scanning exposure apparatus; and then (b) subjecting the photothermographic imaging material to thermal development at a temperature of 80 to 200° C.

DETAILED DESCRIPTION OF THE INVENTION

The present invention will now be detailed.

The silver salt photothermographic dry imaging materials of the present invention contain a compound represented by Formula (A) or Formula (B).

A compound represented by Formula (A) will be described.

In the group represented by Formula (α), Z is $OR^2$, X or OH, and "n" is an integer of 1 to 3, and X is a chlorine atom or a bromine atom.

In Formula (α), each $R^1$ and $R^2$ is a straight-chained, branched or cyclic alkyl group of 1 to 30 carbon atoms (e.g., methyl, ethyl, butyl, octyl, dodecyl, cycloalkyl), an alkenyl group (e.g., propenyl, butenyl, nonenyl), an alkynyl group (e.g., ethynyl, bis-ethynyl, phenyl-ethynyl), an aryl group or a heterocyclic group (e.g., phenyl, naphtyl, tetrahydropyranyl, pyridyl, furyl, thienyl, imidazole, thiazole, thiadiazole, oxadiazole). These groups may further have a substituent of an electron-withdrawing group or an electron-donating group.

Examples of said substituents are an alkyl group of 1 to 25 carbon atoms (e.g., methyl, ethyl, propyl, isopropyl, tert-butyl, pentyl, hexyl, cyclohexyl), a halogenated alkyl group (e.g., trifluoromethyl, perfluorooctyl), a cycloalkyl group (e.g., cyclohexyl, cyclopentyl), an alkynyl group (e.g., propynyl), a glycidyl group, an acrylate group, a methacrylate group, an aryl group (e.g., phenyl), a heterocyclic group (e.g., pyridyl, thiazolyl, oxazolyl, imidazolyl, furyl, pyrrolyl, pyrazinyl, pyrimidinyl, selenazolyl, sulfolanyl, piperidinyl, pyrazolyl, tetrazolyl), a halide atom (e.g., chlorine, bromine, iodine, fluorine), an alkoxy group (e.g., methoxy, ethoxy, propoxy, cyclopentyloxy, hexyloxy, cyclohexyloxy), an aryloxy group (e.g., phenoxy), an alkoxycarbonyl group (e.g., methoxycarbonyl, ethoxycarbonyl, butoxycarbonyl), an aryloxycarbonyl group (e.g., phenoxycarbonyl), a sulfonamide group (e.g., methanesufonamide, ethanesulfonamide, butanesulfonamide, hexanesulfonamide, cyclohexanesulfonamide, benzenesulfonamide), a sulfamoyl group (e.g., aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl), a ureido group (e.g., methylureide, ethylureide, pentylureide, cyclohexylureide, phenylureide, 2-pyridylueide), an acyl group (e.g., acetyl, propionyl, butanoyl, hexanoyl, cyclohexanoyl, benzoyl, pyridinoyl), a carbamoyl group (e.g., aminocarbonyl, methylaminocarbonyl, dimethylaminocarbonyl, propylaminocarbonyl, pentylaminocarbonyl, cyclohexylaminocarbonyl, phenylaminocarbonyl, 2-pyridylaminocarbonyl), an amido group (e.g., acetamide, propionamide, butanamide, hexanamide, benzamide), a sulfonyl group (e.g., methysulfonyl, ethylsulfonyl, butylsulfonyl, cyclohexylsulfonyl, phenylsulfonyl, 2-pyridylsulfonyl), an amino group (e.g., amino, ethylamino, dimethylamino, butylamino, cyclopentylamino, anilino, 2-pyridylamino), a cyano group, a nitro group, a sulfo group, a carboxyl group, a hydroxyl group, or an oxamoyl group. Each of these groups may further be substituted with other substituents described above.

Particularly, $R^1$ and $R^2$ are preferably an unsubstituted alkyl group having 1 to 3 carbon atoms.

A plurality of the substituents represented by Formula (α) may exist in one molecule of a compound represented by Formula (A), but only one substituent is preferred.

Examples of groups represented by $R^3$, $R^4$ and $R^5$ in Formula (A) are the same as defined for the above described $R^1$ and $R^2$ in Formula (α). In particular, $R^5$ contains a group represented by Formula (α). Further, $R^3$ and $R^4$ may combine with each other to form a ring structure.

A compound represented by Formula (B) of the present invention will be described.

In Formula (B), $Z^2$ is $OR^{22}$, $X^2$, or OH; $n^2$ is an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two selected from the group consisting of primary and secondary amino groups; and X is a chlorine atom or a bromine atom.

$R^{21}$ preferably contains at least two amino groups selected from the group consisting of primary and secondary amino groups.

In Formula (B), $R^{21}$ may combine with another $R^{21}$ to form a structure having a plurality of $Si—Z^2n^2$.

An alkyl group, an alkenyl group, an alkynyl group, an aryl group or a heterocyclic group used for $R^{21}$ and $R^{22}$ in the Formula (B) will be described.

In Formula (B), each $R^1$ and $R^2$ is a straight-chained, branched or cyclic alkyl group of 1 to 30 carbon atoms (e.g., methyl, ethyl, butyl, octyl, dodecyl, cycloalkyl), an alkenyl group (e.g., propenyl, butenyl, nonenyl), an alkynyl group (e.g., ethynyl, bis-ethynyl, phenyl-ethynyl), and an aryl group or the heterocyclic group (e.g., phenyl, naphtyl, tetrahydropyranyl, pyridyl, furyl, thienyl, imidazolyl, thiazolyl, thiadiazolyl, oxadiazolyl). These groups may further have a substituent of an electron-withdrawing group or an electron-donating group.

Examples of said substituents are an alkyl group of 1 to 25 carbon atoms (e.g., methyl, ethyl, propyl, isopropyl, tert-butyl, pentyl, hexyl, cyclohexyl), a halogenated alkyl group (e.g., trifluoromethyl, perfluorooctyl), a cycloalkyl group (e.g., cyclohexyl, cyclopentyl), an alkynyl group (e.g., propynyl), a glycidyl group, an acrylate group, a methacrylate group, an aryl group (e.g., phenyl), a heterocyclic group (e.g., pyridyl, thiazolyl, oxazolyl, imidazolyl, furyl, pyrrolyl, pyrazinyl, pyrimidinyl, selenazolyl, sulfolanyl, piperidinyl, pyrazolyl, tetrazolyl), a halide atom (e.g., chlorine, bromine, iodine, fluorine), an alkoxy group (e.g., methoxy, ethoxy, propoxy, cyclopentyloxy, hexyloxy, cyclohexyloxy),an aryloxy group (e.g., phenoxy), an alkoxycarbonyl group (e.g., methyloxycarbonyl, ethyloxycarbonyl, butyloxycarbonyl), an aryloxycarbonyl group (e.g., phenyloxycarbonyl), a sulfonamide group (e.g., methanesufonamide, ethanesulfonamide, butanesulfonamide, hexanesulfonamide, cyclohexanesulfonamide, benzenesulfonamide), a sulfamoyl group (e.g., aminosulfonyl, methylaminosulfonyl, dimethylaminosulfonyl, butylaminosulfonyl, hexylaminosulfonyl, cyclohexylaminosulfonyl, phenylaminosulfonyl, 2-pyridylaminosulfonyl), a urethane group (e.g., methylureide, ethylureide, pentylureide, cyclohexylureide, phenylureide, 2-pyridylueide), an acyl group (e.g., acetyl, propionyl, butanoyl, hexanoyl, cyclohexanoyl, benzoyl, pyridinoyl), a carbamoyl group (e.g., aminocarbonyl, methylaminocarbonyl, dimethylaminocarbonyl, propylaminocarbonyl, pentylaminocarbonyl, cyclohexylaminocarbonyl, phenylaminocarbonyl, 2-pyridylaminocarbonyl), an amido group (e.g., acetamide, propionamide, buthanamide, hexanamide, benzamide), a sulfonyl group (e.g., methysulfonyl, ethylsulfonyl, butylsulfonyl, cyclohexylsulfonyl, phenylsulfonyl, 2-pyridylsulfonyl), an amino group (e.g., amino, ethylamino, dimethylamino, butylamino, cyclopentylamino, anilino, 2-pyridylamino), a cyano group, a nitro group, a sulfo group, a carboxyl group, a hydroxyl group, or an oxamoyl group. Each of these groups may further be substituted with other substituents described above.

Among these, $R^{21}$ is preferably an alkyl group of 1 to 6 carbon atoms that contains at least one primary amino group or at least two primary or secondary amino groups. "At least two selected from the group consisting of primary and secondary amino groups" includes the following cases:

(i) at least one primary amino group and one secondary amino group;

(ii) at least two primary amino groups; and (iii) at least two secondary amino groups.

In all of these cases, at least two amino groups are contained.

$R^{22}$ is preferably an unsubstituted alkyl group having 1 to 3 carbon atoms.

A primary amino group and a secondary amino group that are contained in $R^{21}$ will be described below.

Said primary or secondary amino group of the present invention includes amide, urethane, urea, thiourea, sulfonamide or hydrazine, in addition to an amino group. Further, said amino group may be substituted. Examples of substituents onto said amino group are the same substituents as defined for the above $R^1$ and $R^2$ in Formula ($\alpha$). Furthermore, secondary amino groups may combine with each other to form a ring structure.

A compound represented by Formula (A), or a compound represented by Formula (B) may be employed as a salt of hydrochloric acid or sulfuric acid.

Listed as examples of compounds of the present invention, represented by Formula (A), or by Formula (B) (hereinafter, merely referred to also as silyl compounds of the present invention), are shown below, but the present invention is not limited to these examples.

A-1

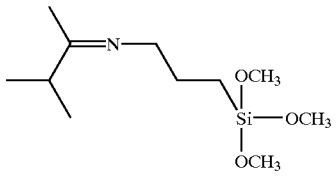

A-2

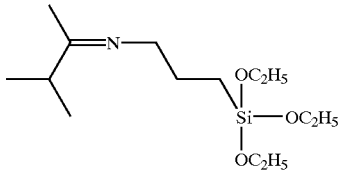

A-3

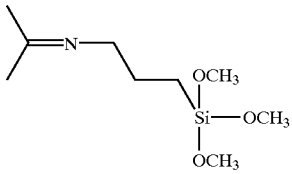

A-4

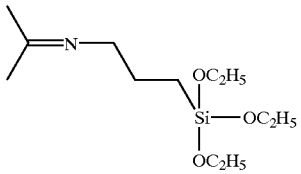

A-5

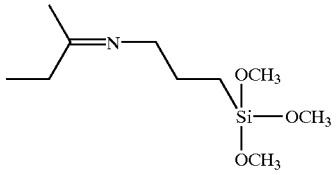

A-6

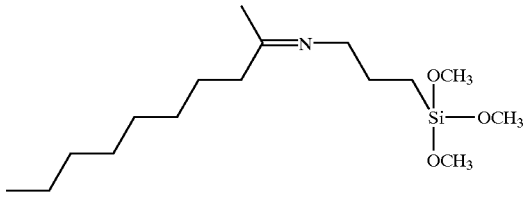

A-7

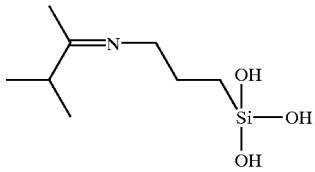

A-8

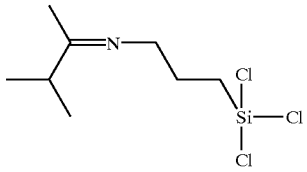

-continued
B-1
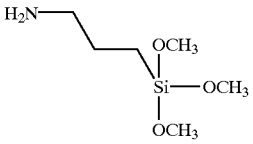
B-2
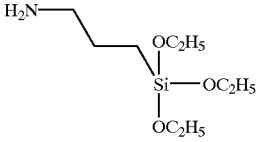
B-3
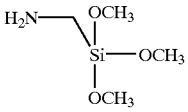
B-4
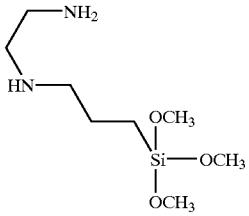
B-5
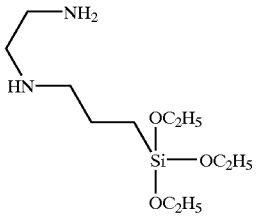
B-6
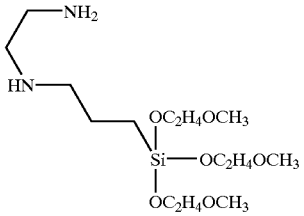
B-7
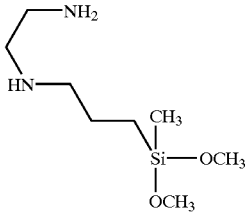
B-8
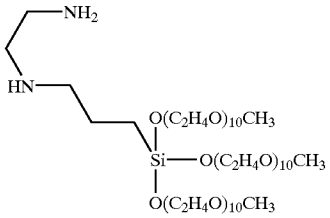
-continued
B-9
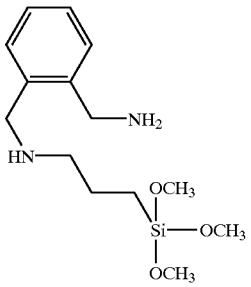
B-10
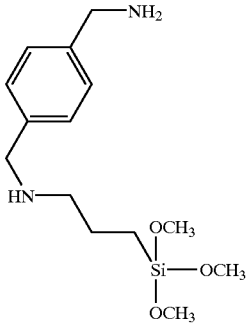
B-11
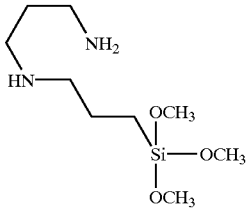
B-12
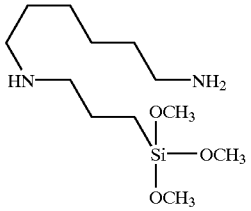
B-13
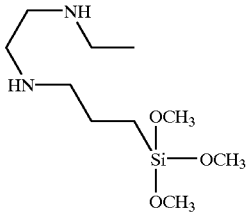
B-14
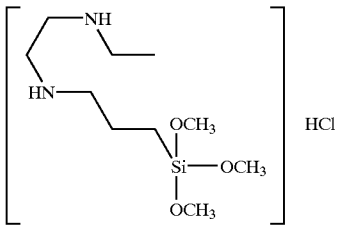

-continued
B-15
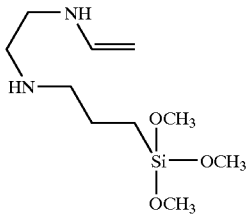
B-16
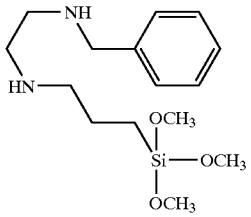
B-17
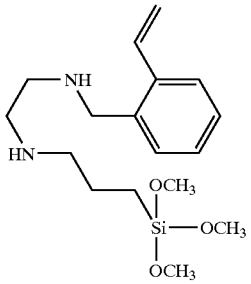
B-18
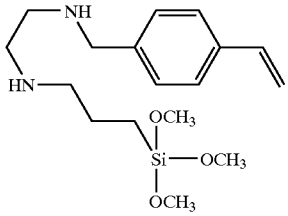
B-19
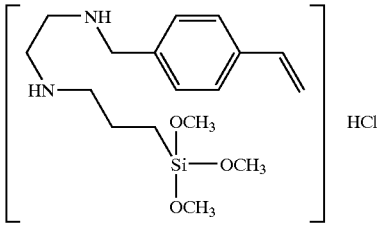
B-20
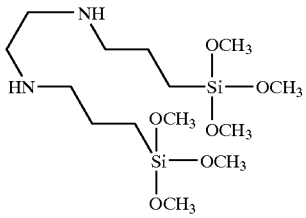
B-21
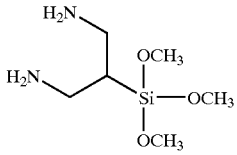
-continued
B-22
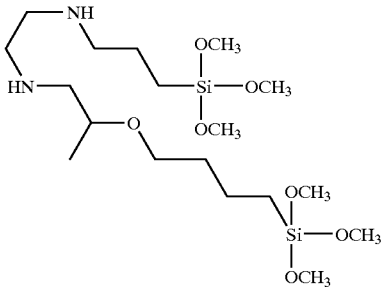
B-23
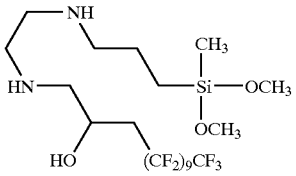
B-24
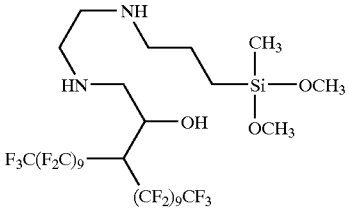
B-25
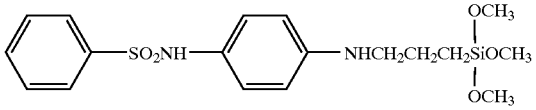
B-26
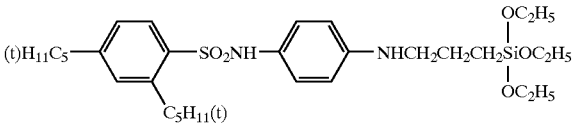
B-27
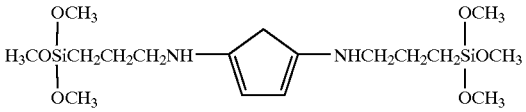
B-28
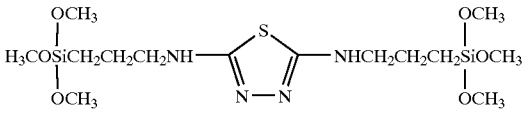
B-29
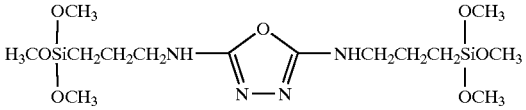
B-30
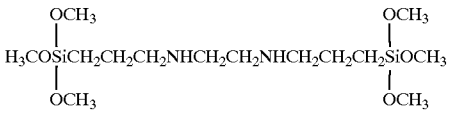

-continued

B-31

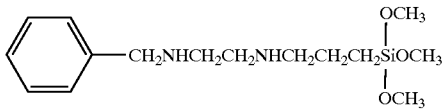

B-32

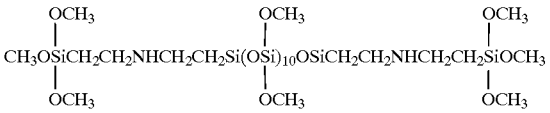

B-33

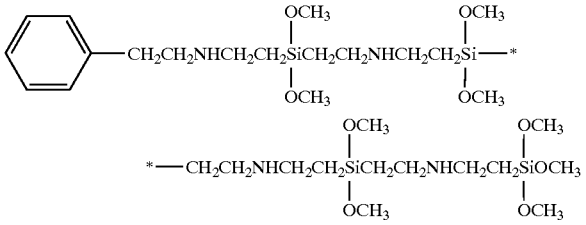

B-34

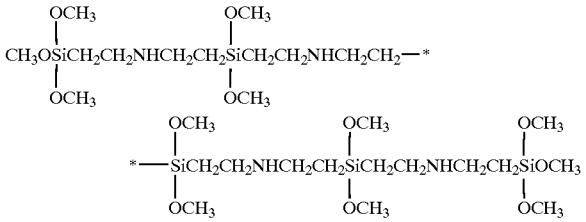

B-35

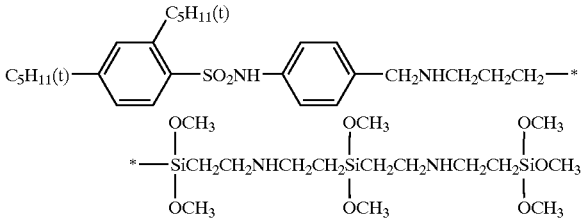

B-36

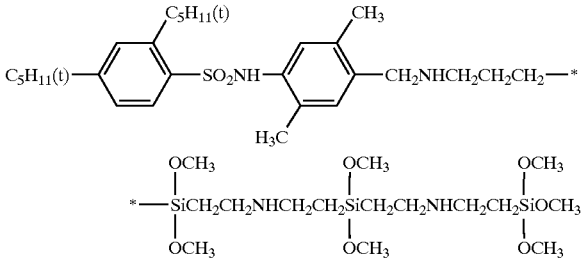

B-37

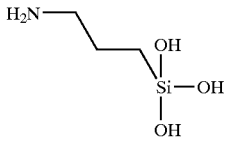

B-38

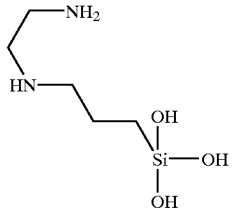

-continued

B-39

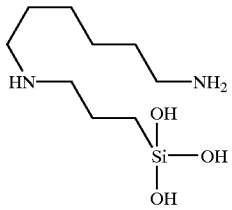

B-40

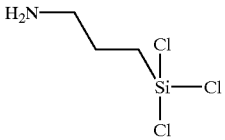

B-41

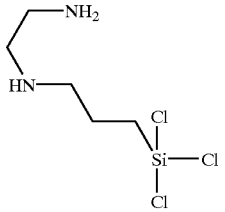

B-42

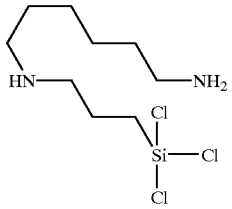

The above-mentioned compounds can be synthesized in accordance with a method employing an alkoxy silane or a silyl halide as starting raw materials and combining them with a linking group. Further, hydroxy silyl compound can be obtained by adding water of an amount of more than the chemical equivalent volume to an alkoxy silane or a silyl halide.

In the present invention, the addition of said silyl compound is carried out in accordance with conventionally known methods. For example, a silyl compound may be added after having been dissolved in a polar solvent such as alcohols (e.g., methanol and ethanol), ketones (e.g., methyl ethyl ketone and acetone), dimethyl sulfoxide or dimethylformamide. Hydroxy silyl compounds may be added as an aqueous solution. Further, silyl compounds may be added as dispersed fine particles in water or organic solvent. The dispersion can be carried out by employing a disperser such as a sand mill, a jet mill, an ultra-sonic disperser or a homogenizer, to obtain an average particle diameter of at most 1 $\mu$m. Furthermore, used may be any dispersion methods employing a sand mill disperser using glass beads or fine zirconia particle media, shattering the silyl compound solution by ejecting it at a high speed from a narrow tube onto a hard plate, or making silyl compound solution collide with each other in two directions from the narrow tube. The fine particle dispersion has preferably an average particle diameter of not less than 1 nm and not more than 10 $\mu$m in an aqueous solution, and also preferably a narrow distribution of dispersed particles. When said silyl compound is dispersed into an aqueous solution, an aqueous solvent generating minimal foam during string is preferred. Regarding fine particle dispersing techniques, many techniques are conventionally disclosed, and the dispersion of the present invention may be carried out in accordance with the optimal technique.

In order to obtain a high density image of the present invention, the use of a compound represented by Formula (B) is preferable. Further, $R^{21}$ is preferably an alkyl group, an alkenyl group, an alkynyl group, an aryl group or a heterocyclic group, provided that $R^{21}$ contains at least one primary amino group or at least two primary or secondary amino groups. And $Z^2$ is preferably a group represented by $OR^{22}$.

A silyl compound of the present invention may be added into the layer containing additives such as a silver halide, an organic silver salt or a reducing agent, or into the layer adjacent to the above additive containing layer, or into an intermediate layer. The amount of said silyl compound of the present invention is preferably $1\times10^{-8}$ to 1.0 mol per 1 mol of silver, especially preferred is, $1\times10^{-5}$ to $1\times10^{-1}$ mol. Said amount of silyl compound may be decided by calculation of converting it into a unit area, when added to a layer other than a sensitized layer which does not contain silver. Increased fog and lowered maximum density may be caused by too much of said added amount, and an insufficient effect of the present invention may be obtained by too little of said added amount.

The amount of a silver coverage of the present invention can be measured by a known analytical method. For example, silver salt photothermographic dry imaging material is cut to a suitable size, and the cut film is set into X-ray fluorescence analysis system model 3080 (manufactured by Rigaku Denki Kougyou Corp.). Thus, the silver coverage can be calculated by measuring X-ray intensity of the objective element.

The silver coverage of the present invention is preferably at least 0.8 $g/m^2$ and at most 2.5 $g/m^2$. More preferably the silver coverage is from 0.8 to 1.6 $g/m^2$. When the silver coverage is less than 0.8 $g/m^2$, sufficient sensitivity or maximum density may not be obtained. And, when the silver coverage is more than 2.5 $g/m^2$, an increase of fog may result.

The light sensitive silver halide, contained in the light sensitive layer of the silver salt photothermographic dry imaging material, used in the present invention can be prepared by using any of the several methods known in the field of the photographic industry, of single-jet or double-jet addition, and any one of an ammonia precipitation, a neutral precipitation and an acidic precipitation. A silver halide functions as a photo-sensor. In order to minimize cloudiness or white turbidness after image formation and to obtain excellent image quality, the size of silver halide grains are preferably smaller than that used in a wet processing silver halide photographic material. The average grain size is preferably 0.01 $\mu$m to 0.15 $\mu$m, and more preferably 0.03 $\mu$m to 0.10 $\mu$m. If less than 0.01 $\mu$m, sufficient sensitivity or maximum densities may not be obtained. Further, if exceeding 0.15 $\mu$m, sufficient maximum densities may not be obtained or high fog densities may result.

The silver halide grain shape is not specifically limited, and can be any one of several shapes, including so-called regular crystals in the form of a cube or an octahedron but not regular crystals of spherical, cylindrical and tabular grains. Further, the composition of silver halide grains is not limited and may be any one of silver chloride, silver chlorobromide, silver iodochlorobromide, silver bromide, silver iodobromide or silver iodide.

The silver halide grains of the present invention can be prepared by converting a part or all of an organic silver salt to silver halide by employing a silver halide forming component. Examples of such silver halide forming components are; inorganic halides, onium halides, halogenated hydrocarbons and other halides. These are detailed in U.S. Pat. Nos. 4,009,039, 3,457,075 and 4,003,749, British Pat. No. 1,498,956, Japanese Patent Publication Open to Public Inspection (hereinafter referred to as JP-A) Nos. 53-27027 and 53-25420. The conditions of the production process of conversion to silver halide such as reaction time, reaction temperature and reaction pressure are appropriately set up according to the objective of silver halide preparation, and a generally preferable set-up is a reaction temperature of −23° C. to 74° C., a reaction time of 0.1 second to 72 hours and a reaction pressure of atmospheric pressure.

The light sensitive silver halide prepared by various of the above-mentioned methods may be chemically sensitized by, for example, a sulfur containing compound, a gold compound, a platinum compound, a palladium compound, a silver compound, a tin compound, a chromium compound and a combination of these compounds. A method and a procedure of said chemical sensitization are described in such as U.S. Pat. No. 4,036,650, British Patent No. 1,518,850, JP-A Nos. 51-22430, 51-78319 and 51-81124.

The silver halide used in the present invention may be sensitized by a spectral sensitizing dye, if required. The sensitizing dyes described in the following references can be employed: JP-A Nos. 63-159841, 60-140335, 63-231437, 63-259651, 63-304242 and 63-15245, and U.S. Pat. Nos. 4,639,414, 4,740,455, 4,741,966, 4,751,175 and 4,835,096. Particularly, the sensitizing dyes having a spectral sensitivity suitable for spectral characteristics of light sources of various types of scanners can advantageously be selected. For example, dyes are preferably selected from compounds described in JP-A Nos. 9-34078, 9-54409 and 9-80679.

The compound represented by Formula (1) will now be explained.

In the present invention, the compound represented by Formula (1) and a macrocyclic compound (both are disclosed in JP-A No. 2001-330918) may be employed as a supersensitizer.

In the above-mentioned Formula (1), the bivalent aliphatic hydrocarbon linking group, represented by T includes a straight-chain, a branched or a cyclic alkylene group (preferably having 1 to 20 carbon atoms, more preferably 1 to 16, and still more preferably 1 to 12), an alkenyl group (preferably having 2 to 20 carbon atoms, more preferably 2 to 16 carbon atoms, and still more preferably 2 to 12 carbon atoms), an alkynyl group (preferably having 2 to 20 carbon atoms, more preferably 2 to 16 carbon atoms, and still more preferably 2 to 12 carbon atoms), each of which may be substituted by substituent group(s). The substituent groups are; an aliphatic hydrocarbon groups, for example, an alkyl group (preferably having 1 to 20 carbon atoms, more preferably 1 to 16 carbon atoms, and still more preferably 1 to 12 carbon atoms), an alkenyl group (preferably having 2 to 20 carbon atoms, more preferably 2 to 16 carbon atoms, and still more preferably 2 to 12 carbon atoms), an alkynyl group (preferably having 2 to 20 carbon atoms, more preferably 2 to 16 carbon atoms, and still more preferably 2 to 12 carbon atoms), a monocyclic or condensed cyclic aryl group having 6 to 20 carbon atoms (e.g., phenyl or naphthyl but preferably phenyl), and a saturated or unsaturated heterocyclic group having 3 to 10 members (e.g., 2-thiazolyl, 1-piperazinyl, 2-pyridyl, 3-pyridyl, 2-furyl, 2-thienyl, 2-benzimidazolyl, carbazolyl). The heterocyclic group may be a monocyclic ring or a ring condensed with other rings. These groups each may further be substituted at any position. Examples of such substituent groups include an alkyl group (including a cycloalkyl group and an aralkyl group, and preferably having 1 to 20 carbon atoms, more preferably 1 to 12 carbon atoms, and still more preferably 1 to 8 carbon atoms, such as methyl, ethyl, n-propyl, isopropyl, n-butyl, tert-butyl, n-heptyl, n-octyl, n-decyl, n-undecyl, n-hexadecyl, cyclopropyl, cyclopentyl, cyclohexyl, benzyl, or phenethyl), an alkenyl group (preferably having 2 to 20 carbon atoms, more preferably 2 to 12 carbon atoms, and still more preferably 2 to 8 carbon atoms, e.g., vinyl, allyl, 2-butenyl, or 3-pentenyl), an alkynyl group (preferably having 2 to 20 carbon atoms, more preferably 2 to 12 carbon atoms, and still more preferably 2 to 8 carbon atoms, e.g., propynyl, or 3-pentynyl), an aryl group (preferably having 6 to 30 carbon atoms, more preferably 6 to 20 carbon atoms, and still more preferably 6 to 12 carbon atoms, e.g., phenyl, p-tolyl, o-aminophenyl, or naphthyl), an amino group (preferably having 0 to 20 carbon atoms, more preferably 0 to 10 carbon atoms, and still more preferably 0 to 6 carbon atoms, e.g., amino, methylamino, ethylamino, dimethylamino, diethylamino, diphenylamino, or dibenzylamino), an imino group (preferably having 1 to 20 carbon atoms, more preferably 1 to 18 carbon atoms, and still more preferably 1 to 12 carbon atoms, e.g., methylimino, ethylimino, propylimino, or phenylimino), an alkoxy group (preferably having 1 to 20 carbon atoms, more preferably 1 to 12 carbon atoms, and still more preferably 1 to 8 carbon atoms, e.g., methoxy, ethoxy, ethoxy, or butoxy), an aryloxy group (preferably having 6 to 20 carbon atoms, more preferably 6 to 16 carbon atoms, still more preferably 6 to 12 carbon atoms, e.g., phenoxy, or 2-naphthyloxy), an acyl group (preferably having 1 to 20 carbon atoms, more preferably 1 to 16 carbon atoms, and still more preferably 1 to 12 carbon atoms, e.g., acetyl, benzoyl, formyl, or pivaloyl), an alkoxycarbonyl group (preferably having 2 to 20 carbon atoms, more preferably 2 to 16 carbon atoms, and still more preferably 2 to 12 carbon atoms, e.g., methoxycarbonyl or ethoxycarbonyl), an aryloxycarbonyl group (preferably having 7 to 20 carbon atoms, more preferably 7 to 16 carbon atoms, and still more preferably 7 to 10 carbon atoms, e.g., phenoxycarbonyl), an acyloxy group (preferably having 1 to 20 carbon atoms, more preferably 1 to 16 carbon atoms, and still more preferably 1 to 10 carbon atoms, e.g., acetoxy, benzoyloxy), an acylamino group (preferably having 1 to 20 carbon atoms, more preferably 1 to 16 carbon atoms, and still more preferably 1 to 10 carbon atoms, e.g., acetylamino or benzoylamino), alkoxycarbonylamino group (preferably having 2 to 20 carbon atoms, more preferably 2 to 16 carbon atoms, and still more preferably 2 to 12 carbon atoms, e.g., methoxycarbonylamino), aryloxycarbonylamino group (preferably having 7 to 20 carbon atoms, more preferably 7 to 16 carbon atoms, and still more preferably 7 to 12 carbon atoms, e.g., phenoxycarbonylamino), a sulfonylamino group (preferably having 1 to 20 carbon atoms, more preferably 1 to 16 carbon atoms, and still more preferably 1 to 12 carbon atoms, e.g., methanesulfonylamino or benzenesulfonylamino), a sulfamoyl group (preferably having 0 to 20 carbon atoms, more preferably 0 to 16 carbon atoms, and still more preferably 0 to 12 carbon atoms, e.g., sulfamoyl, methylsulfamoyl, dimethylsulfamoyl, or phenylsulfamoyl), a carbamoyl group (preferably having 1 to 20 carbon atoms, more preferably 1 to 16 carbon atoms, and still more preferably 1 to 12 carbon atoms, e.g., carbamoyl, methycarbamoyl, or diethylcarbamoyl, phenylcarbamoyl), an alkylthio group (preferably having 1 to 20 carbon atoms, more preferably 1 to 16 carbon atoms, and still more preferably 1 to 12 carbon atoms, e.g., methylthio or ethylthio), an arylthio group (preferably having 6 to 20 carbon atoms, more preferably 6 to 16 carbon atoms, and still more preferably 6 to 12 carbon atoms, e.g., phenylthio), a sulfonyl group (preferably having 1 to 20 carbon atoms, more preferably 1 to 16 carbon atoms, and still more preferably 1 to 12 carbon atoms, e.g., methanesulfonyl or tosyl), a sulfinyl group (preferably having 1 to 20 carbon atoms, more preferably 1 to 16 carbon atoms, and still more preferably 1 to 12 carbon atoms, e.g., methanesulfinyl or benzenesulfinyl), an ureido group (preferably having 1 to 20 carbon atoms, more preferably 1 to 16 carbon atoms, and still more preferably 1 to 12 carbon atoms, e.g., ureido, methylureido, or phenylureido), a phosphoric amide group (preferably having 1 to 20 carbon atoms, more preferably 1 to 16 carbon atoms, and still more preferably 1 to 12 carbon atoms, e.g., diethylphosphoric acid amide or phenylphosphoric acid amide), a hydroxy group, a mercapto group, a halogen atom (e.g., fluorine atom, chlorine atom, bromine atom, or iodine atom), a cyano group, a sulfo group, a sulfino group, a carboxyl group, a phosphono group, a phosphino group, a nitro group, a hydroxamic acid group, a hydrazine group, and a heterocyclic group (e.g., imidazolyl, benzimidazolyl, thiazolyl, benzothiazolyl, carbazolyl, pyridyl, furyl, piperidinyl, or morpholinyl).

Of the substituent groups described above, a hydroxy group, a mercapto group, a sulfo group, a sulfino group, a carbokyl group, a phosphono group, and a phosphino group include their salts. These substituent groups may be further substituted. In this case, plural substituents may be the same or different.

The preferred substituent groups include an alkyl group, an aralkyl group, an alkoxy group, an aryl group, an alkylthio group, an acyl group, an acylamino group, an imino group, a sulfamoyl group, a sulfonyl group, a sulfonylamino group, a ureido group, an amino group, a halogen atom, a nitro group, a heterocyclic group, an alkoxycarbonyl group, a hydroxy group, a sulfo group, a carbamoyl group, and a carboxyl group. Specifically, an alkyl group, an alkoxy group, an aryl group, an alkylthio group, an acyl group, an acylamino group, an imino group, a sulfonylamino group, a ureido group, an amino group, a halogen atom, a nitro group, a heterocyclic group, an alkoxycarbonyl group, a hydroxy group, a sulfo group, a carbamoyl group, and a carboxyl group are more preferred; and an alkyl group, an alkoxy group, an aryl group, an alkylthio group, an acylamino group, an imino group, a ureido group, an amino group, a heterocyclic group, an alkoxycarbonyl group, a hydroxy group, a sulfo group, a carbamoyl group, and a carboxyl group are still more preferred. An amidino group having a substituent or without a substituent is also preferable. Examples of the substituents on the amidino group include an alkyl group (e.g., methyl, ethyl, pyridylmethyl, benzyl, phenethyl, carboxybenzyl, and aminophenylmethyl), an aryl group (e.g., phenyl, p-tolyl, naphthyl, o-aminophenyl, and o-methoxyphenyl), and a heterocyclic group (e.g., 2-thyazolyl, 2-pyridyl, 3-pyridyl, 2-furyl, 3-furyl, 2-thieno, 2-imidazolyl, benzothiazolyl, and carbazolyl).

Examples of bivalent linking groups represented by J that contains at least one of an oxygen atom, a sulfur atom or a nitrogen atom are listed as follows. These linking groups may combine with each other.

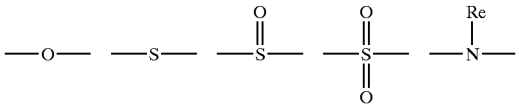

-continued

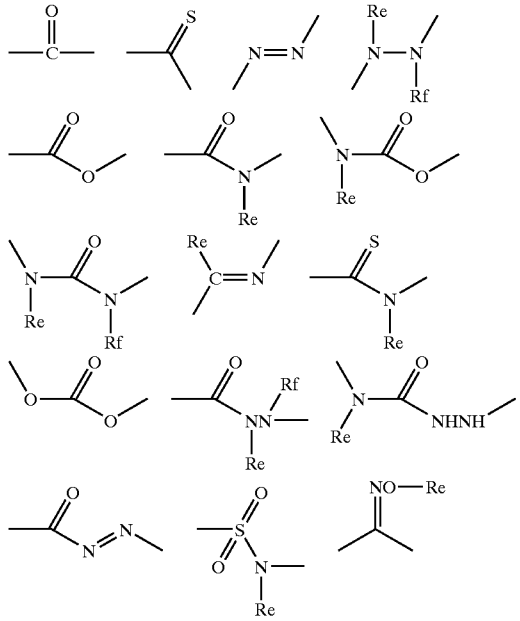

Wherein, Re and Rf are the same as defined for Ra through Rd.

An aromatic hydrocarbon group represented by Q is a monocyclic or condensed aryl group (preferably having 6 to 30 carbon atoms, and more preferably 6 to 20 carbon atoms).

Examples of these include phenyl and naphthyl, and phenyl is preferred. An aromatic heterocyclic group represented by Q is a 5- to 10-membered unsaturated heterocyclic group containing at least either N, O or S, and may be monocyclic or condensed with other rings. A heterocyclic ring of the heterocyclic group is preferably a 5- or 6-membered aromatic heterocyclic ring or its benzo-condensed ring, more preferably a nitrogen-containing, 5- or 6-membered aromatic heterocyclic ring or its benzo-condensed ring, and still more preferably one or two nitrogen-containing, 5- or 6-membered aromatic heterocyclic ring or its benzo-condensed ring.

Examples of the aromatic heterocyclic groups include groups derived from thiophene, furan, pyrrole, imidazole, pyrazole, pyridine, pyrazine, pyridazine, triazole, triazine, indole, indazole, purine, thiadiazole, oxadiazole, quinoline, phthalazine, naphthylizine, quinoxaline, quinazoline, cinnoline, pteridine, acridine, phenanthroline, phenazine, tetrazole, thiazole, oxazole, benzimidazole, benzoxazole, benzothiazole, benzothiazoline, benzotriazole, tetrazaindene, and carbazole. Of these, groups derived from imidazole, pyrazole, pyridine, pyrazine, indole, indazole, thiadiazole, oxadiazole, quinoline, phenazine, tetrazole, thiazole, oxazole, benzimidazole, benzoxazole, benzothiazole, benzothiazoline, benzotriazole, tetrazaindene, and carbazole are preferred; and groups derived from imidazole, pyridine, pyrazine, quinoline, phenazine, tetrazole, thiazole, benzoxazole, benzimidazole, benzothiazole, benzothiazoline, benzotriazole, and carbazole are more preferred.

An aromatic hydrocarbon groups and aromatic heterocyclic groups represented by Q may be substituted. The substituent groups are the same as the substituent groups defined for T, and the preferable range is also the same. The substituent groups may be further substituted. When there are a plurality of substituents, they may be the same or different. Further, the group represented by Q is preferably an aromatic heterocyclic group.

An aliphatic hydrocarbon group, aryl group and heterocyclic group, represented by Ra, Rb, Rc, and Rd, are the same as the groups of examples of an aliphatic hydrocarbon group, aryl group and heterocyclic group for the above-mentioned T. The preferable range is also the same. An acyl group represented by Ra, Rb, Rc and Rd includes an aliphatic or aromatic group, having 1 to 12 carbon atoms, such as acetyl, benzoyl, formyl and pivaloyl. A nitrogen containing heterocyclic group formed by combinations of Ra and Rb, Rc and Rd, Ra and Rc, or Rb and Rd includes a 3- to 10-membered, saturated or unsaturated heterocyclic ring (e.g., ring groups such as piperidine ring, piperadine ring, acridine ring, pyrrolidine ring, pyrrole ring, or morpholine ring).

Examples of acid anions represented by M and used for neutralizing a molecular charge are; a halide ion (e.g., chloride ion, bromide ion, and iodide ion), a p-toluenesulfonate ion, a perchlorate ion, a tetrafluoroborate ion, a sulfate ion, a methylsulfate ion, an ethylsulfate ion, a methanesulfonic acid ion and a trifluoromethanesulfonic acid ion.

Examples of compounds represented by Formula (1) are shown below but the present invention are not limited to these examples.

1-1

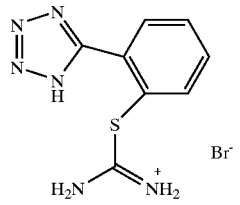

1-2

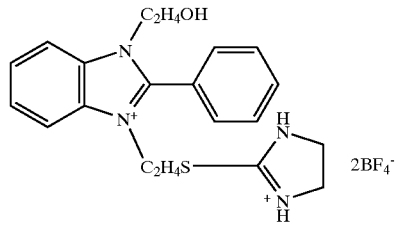

1-3

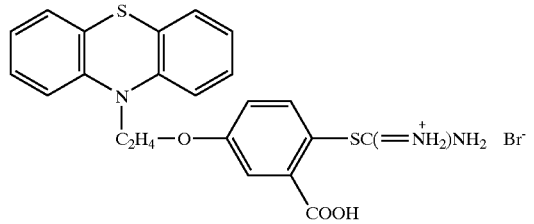

1-4

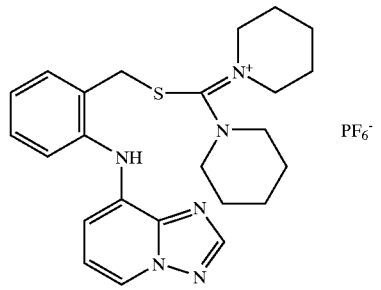

-continued
1-5
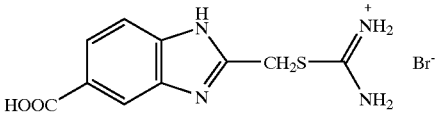
1-6
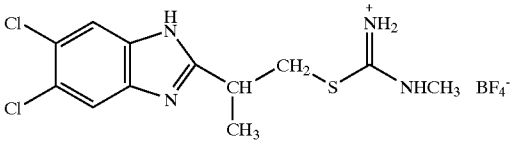
1-7
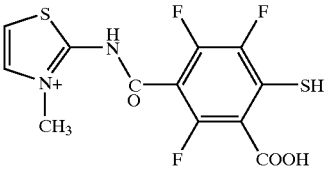
1-8
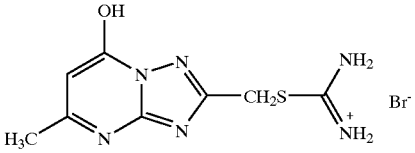
1-9
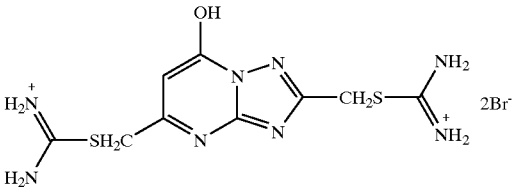
1-10
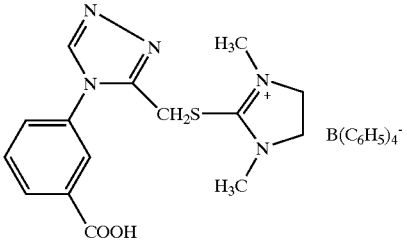
1-11
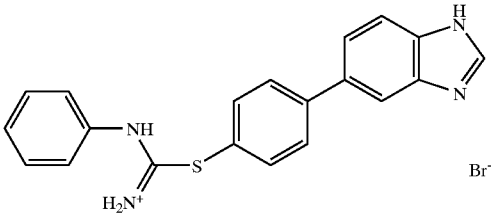
1-12
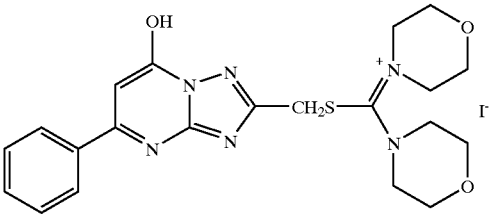
-continued
1-13
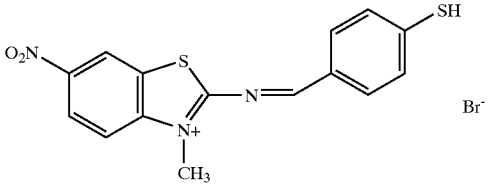
1-14
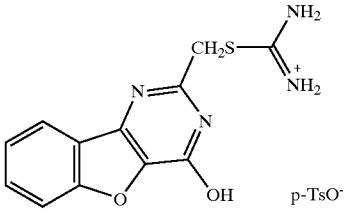
1-16
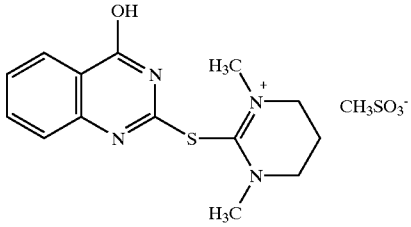
1-17
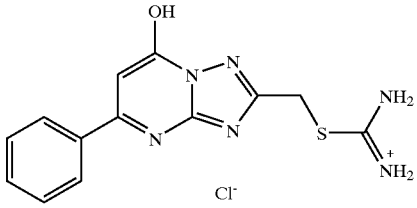
1-18
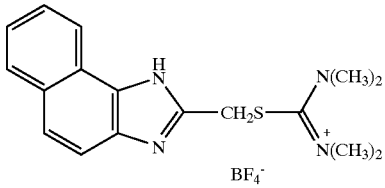
1-19
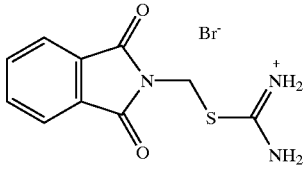
1-20
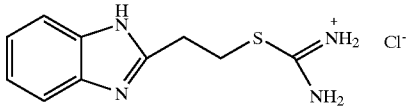
1-21
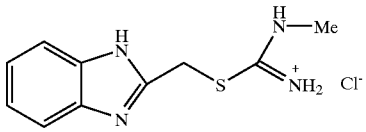

-continued 1-22

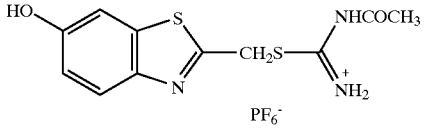

1-23

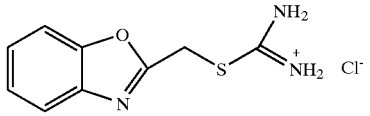

1-24

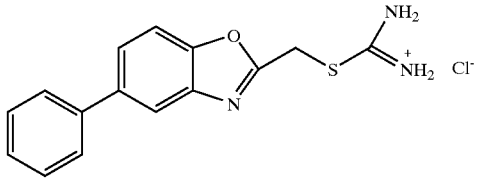

1-25

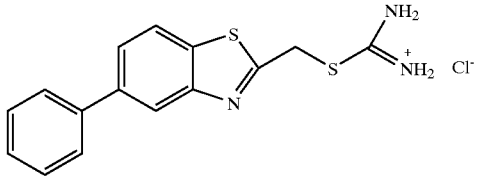

1-26

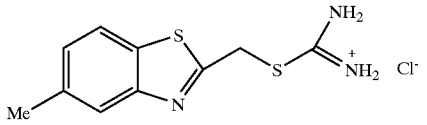

1-27

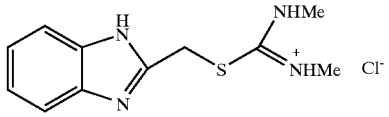

1-28

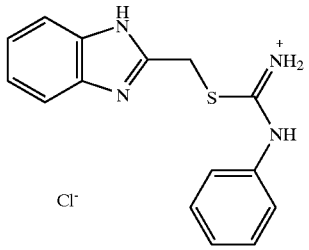

1-29

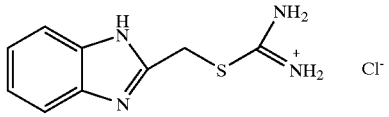

1-30

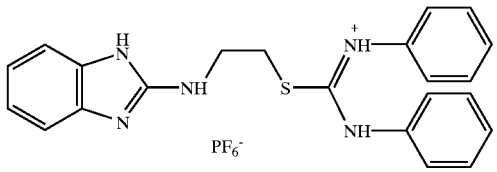

-continued 1-31

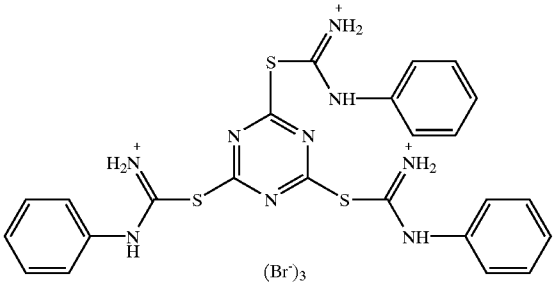

The compound (supersensitizer) of the present invention, represented by Formula (1) is employed in an emulsion layer containing organic silver salt and silver halide grains in an amount of preferably 0.001 to 1.0 mol per 1 mol of silver. Especially the preferable amount of the compound is 0.01 to 0.5 mol per mol of silver.

Organic silver salts used in the present invention of silver salt photothermographic dry imaging material are silver sources capable to be reduced. Silver salts of organic acids, hetero organic acids and polymer acids are employed. Specifically, organic or inorganic silver complexes, ligands of which having a total stability constant to a silver ion of 4.0 to 10.0 are preferred. Preferred organic acids employed to prepare a preferable organic silver salt are such as gallic acid, oxalic acid, behenic acid, stearic acid, palmitic acid and lauric acid. The organic silver salts can be prepared by mixing an alkali metal salt of the above-mentioned organic acid and silver nitrate. Both solutions may be mixed by a controlled double jet method or either one the solutions may be added by shifting the timing of addition of each component. One of the solutions may be portioned and added in several times or at one time of a selected time during formation of silver salts.

The suitable examples of the reducing agents to be included in the silver salt photothermographic dry imaging material of the invention are suitably selected from reducing agents well known in the art. Such reducing agents are; polyphenols in which two or more phenol groups are bonded by an alkylene group or sulfur, and particularly polyphenols in which at least one position of adjacent to hydroxy substituted positions being substituted by an alkyl group (such as a methyl group, an ethyl group, a propyl group, a t-butyl group and an cyclohexyl group) or an acyl group (such as an acetyl group and a propionyl group), are bonded by an alkylene group or sulfur. Examples of such compounds are as follows:

(Re1) 1,1-bis(2-hydroxy-3, 5-dimethylphenyl)-3, 5, 5-trimethylhexane
(Re2) 1,1-bis(2-hydroxy-3-t-butyl-5-methylphenyl)methane
(Re3) 1,1-bis(2-hydroxy-3, 5-di-t-butylphenyl)methane
(Re4) 1,1-bis(2-hydroxy-3-methyl-5-t-butylphenyl)methane
(Re5) 1,1-bis[2-hydroxy-3-methyl-5-(1-methylcyclohexyl) phenyl]methane
(Re6) (2-hyrdoxy-3-t-butyl-5-methylphenyl)-(2-hyrdoxy-5-methylphenyl)methane
(Re7) 6, 6'-benzylidene-bis(2,4-di-t-butylphenol)
(Re8) 6, 6'-benzylidene-bis(2-t-butyl-4-methylphenol)
(Re9) 6, 6'-benzylidene-bis(2,4-dimethylphenol)
(Re10) 1, 1-bis(2-hydroxy-3, 5-dimethylphenyl)-2-methylpropane (Re11) 1, 1-bis(2-hydroxy-3, 5-dimethylphenyl)-1-cyclohexylmethane
(Re12) 1, 1-bis(2-hydroxy-3, 5-dimethylphenyl)-1-(2, 4-dimethyl-3-cyclohexenyl)methane
(Re13) 1, 1-bis(2-hydroxy-3, 5-dimethylphenyl)-1-(2-methyl-4-cyclohexenyl)methane
(Re14) 1, 1-bis(2-hydroxy-3, 5-dimethylphenyl)-1-(2-methyl-4-cyclohexyl)methane
(Re15) 1, 1-bis(2-hydroxy-3-methyl-5-t-butylphenyl) propane
(Re16) 1, 1-bis(2-hydroxy-3-methyl-5-t-butylphenyl)butane
(Re17) 1, 1, 5, 5-tetrakis-(2-hydroxy-3, 5-dimethylphenyl)-2, 4-ethylpentane
(Re18) 2, 2-bis(4-hydroxy-3, 5-dimethylphenyl)propane
(Re19) 2, 2-bis(4-hydroxy-3, 5-di-t-butylphenyl)propane.

Further, suitable examples also include polyphenol compounds described in the following references: U.S. Pat. Nos. 3,589,903, 4,021,249, British Patent No. 1,486,148, JP-A 51-51933, 50-36110, 50-116023, 52-84727, 2001-56527, 2001-42469, 2001-92075, 2001-188323, and JP-B 51-35727 (JP-B refers to an examined Japanese Patent Publication). Further examples are bisnaphtols described in U.S. Pat. No. 3,672,904 such as 2,2'-dihydroxy-1,1'-binaphtyl, 6,6'-dibromo-2,2'-dihydroxy-1,1'-binaphtyl, 6, 6'-dinitro-2, 2'-dihydroxy-1, 1'-binaphtyl, bis(2-hydroxy-1-naphtyl) methane, and 4, 4'-dimethoxy-1, 1'-dihydroxy-2, 2'-binaphtyl. Further, examples are sulfonamido phenols or sulfonamido naphthols described in U.S. Pat. No. 3,801,321 such as 4-benzenesulfonamido phenol, 2-benzenesulfonamido phenol, 2,6-dichloro-4-benzenesulfonamido phenol and 4-benzenesulfonamido naphthol.

Polymer binders employed in a light sensitive layer or in a non light sensitive layer of the photothermographic imaging material of the present invention include; polyacrylamide, polystyrene, polyvinyl acetate, polyurethane, polyacrylic acid ester, styrene-butadiene copolymer, acrylonitrile-butadiene copolymer, vinyl chloride-vinyl acetate-copolymer, and styrene-butadiene-acryl copolymer. Further preferred binders are these having low equilibrium moisture content after being coated and dried to form a film. Especially low moisture content binders are, for example, such as cellulose acetate, cellulose acetate butylate, cellulose acetate propionate and polyvinylacetal used in an organic solvent.

Polyvinylacetal can be synthesized by acetalization of polyvinylalcohol with an aldehyde such as butylaldehyde or acetaldehyde.

The degree of acetalization is theoretically 1 to 100%, but preferably 20 to 95% for practical use. A low degree of acetalization increases hydroxyl groups and results in showing low resistance to humidity of photographic properties, and a high degree of acetalization requires a higher reaction temperature and a longer reaction time, and results in increased cost and lowered productivity.

The degree of polymerization of polyvinylalcohol used as a starting material is selected from about 10 to about 100,000, but 100 to 6,000 is preferable from the view point of coating characteristics and productivity of synthesis.

When forming a layer with binders alone, adhesion to the under layer and the upper layer can be maintained and layer strength that will not be easily damaged can be obtained. Further, the usage of a cross linking agent is effective to obtain higher layer adhesion and layer strength.

Examples of the cross linking agents of the present invention are listed below. When the cross linking reaction is slow, the photographic properties may not be stable and the storage stability may be deteriorated. The cross linking agents employed in the present invention may be preferably selected from multifunctional types having at least 2 isocyanate groups. The preferred cross linking agents are shown below:

(H1) hexamethylenediisocyanate
(H2) trimer of hexamethylenediisocyanate
(H3) tolyrendiisocyanate
(H4) phenylenediisocyanate
(H5) xylenediisocyanate
(H6) 1,3-bis (isocyanatemethyl) cyclohexane
(H7) tetramethylenexylilenediisocyanate
(H8) m-isopropenil-α,α-dimethylbenzylisocyanate

H9

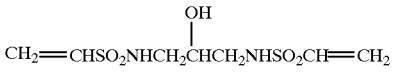

H10

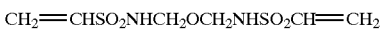

H11

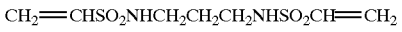

H12

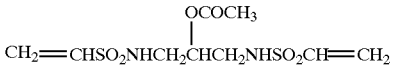

H13

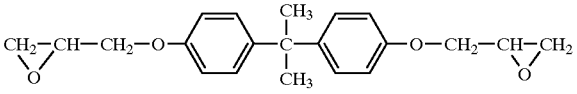

H14

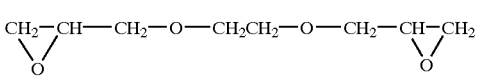

H15

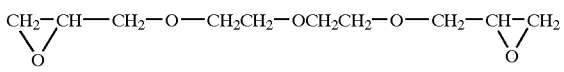

H16

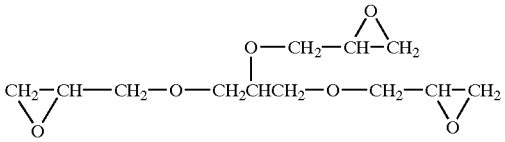

The above-mentioned cross linking agents may be added by dissolving in water, alcohols, ketones or non-polar organic solvents, or added as a solid state to the coating composition. The adding amount of the cross linking agents is preferably equivalent to targeted cross linking groups, and may be increased up to 10 times in volume, and decreased to 1/100 in volume. When too little volume is employed, the cross linking reaction may not proceed, and when too much volume is employed, an unreacted cross linking agent may deteriorate the photographic properties. Thus, both too little and too much amount are not preferred.

The silver salt photothermographic dry imaging material of the present invention comprises, if necessary, an AH (anti-halation)layer or a BC (back-coating) layer in order to obtain an anti-halation effect. The used dyes in said HC layer or BC layer may be any dyes that absorb the light used for image exposure, and preferable examples are described in JP-A H2-216140, H7-13295, H7-11432, and U.S. Pat. No. 5,380,635.

The supports of the present invention are preferably polyethylene terephthalate, polyethylene naphthalate, or syndiotactic polystyrene. The supports are preferably biaxially stretched and thermally fixed in order to obtain a high optical isotropic property and a high dimensional stability. The support thickness is preferably 50 to 400 μm.

The exposure method of the image recording method of the present invention will now be described.

Exposure of the silver salt photothermographic dry imaging material of the present invention may desirably be an argon ion laser, a He—Ne laser, a red semiconductor laser or a near-infrared semiconductor laser. The use of an infrared semiconductor laser is preferred because it has a high output power and it is possible to make the support of photothermographic dry imaging material transparent.

In the present invention, the use of a laser scanning exposure apparatus is preferred, in which the scanning light is exposed at an angle of not substantially vertical to the exposure surface of the silver salt photothermographic dry imaging material.

The expression "laser light is exposed at an angle of not substantially vertical to the exposure surface of the silver salt photothermographic dry imaging material" means that a laser light is exposed preferably at an angle of 55 to 88 degrees during laser scanning, more preferably 60 to 86 degrees, and still more preferably 65 to 84 degrees, and optimally 70 to 82 degrees.

When the silver salt photothermographic dry imaging material is scanned with a laser light, the beam spot diameter on the surface of the silver salt photothermographic dry imaging material is preferably not more than 200 μm, and more preferably not more than 100 μm. Because, the smaller spot diameter preferably reduces the angle displaced from verticality of the laser incident angle.

The lower limit of the beam spot diameter is 10 μm. The above-mentioned laser scanning exposure can reduce deterioration in image quality caused by a reflected light, such as occurrence of interference fringe pattern unevenness.

Exposure applicable to the present invention is preferably conducted by using a laser scanning exposure apparatus that produces a longitudinal multiple scanning laser light. By using this laser light, deterioration in image quality such as occurrence of interference fringe pattern unevenness is reduced, as compared to scanning laser light with a longitudinally single mode.

A longitudinal multiple scanning can be achieved by a technique of composing waves, employing backing light or high frequency overlapping. The expression "longitudinally multiple" means that the exposure wavelength is not a single wavelength. The wavelength distribution is usually not less than 5 nm, and preferably not less than 10 nm. The upper limit of the exposure wavelength is not specifically limited but is usually about 60 nm.

Thermal development of the image forming method of the present invention will now be described.

The silver salt photothermographic dry imaging material of the present invention is stable at a normal temperature (20±15° C.). After exposure, said material is developed by heating to a higher temperature. The heating temperature is preferably 80 to 200° C., and more preferably 100 to 150° C. Sufficiently high image densities cannot be obtained at a temperature lower than 80° C., and at a temperature higher than 200° C., the binder melts and is transferred onto the rollers, and thus, adversely affecting not only image itself but also transportability or the thermal processor. An oxidation-reduction reaction between an organic silver salt (functioning as an oxidant) and a reducing agent is caused upon heating to form silver images. The reaction process proceeds without supplying any processing solution such as water from the exterior.

The present invention will be further described based on examples but embodiments of the present invention are by no means limited to these examples.

EXAMPLE 1

Preparation of Subbed Support

Both surfaces of biaxially stretched thermally fixed 175 μm PET film, available on the market and blue color in to an optical density of 0.170 (measured by densitometer PDA-65, manufactured by Konica Corp.), was subjected to corona discharging at 8 W/m$^2$·min. Onto one side of the film, subbing coating composition a-1 described below was applied to form a dried layer thickness of 0.8 μm, which was then dried. The resulting coating was designated Subbing Layer A-Onto the opposite surface, subbing coating composition b-1 described below was applied to form a dried layer thickness of 0.8 μm, which was then dried. The resulting coating was designated Subbing Layer B-1.

Subbing Coating Composition a-1

| | |
|---|---|
| Latex solution (solid 30%); | 270 g |
| a copolymer consisting of: | |
| butyl acrylate 30 weight %) | |
| t-butyl acrylate (20 weight %) | |
| styrene (25 weight %) | |
| 2-hydroxy ethyl acrylate (25 weight %) | |
| (C-1) | 0.6 g |
| Hexamethylene-1, 6-bis(ethyleneurea) | 0.8 g |
| Water to make | 1 liter |

Subbing Coating Composition b-1

| | |
|---|---|
| Latex solution (solid 30 weight %): | 270 g |
| a copolymer consisting of: | |
| butyl acrylate (40 weight %) | |
| styrene (20 weight %) | |
| glycidyl acrylate (40 weight %) | |
| (C-1) | 0.6 g |
| Hexamethylene-1,6-bis(ethyleneurea) | 0.8 g |
| Water to make | 1 liter |

Subsequently, the surfaces of Subbing Layer A-1 and B-1 were subjected to corona discharging at 8 W/m$^2$·min. Onto said Subbing Layer A-1, the upper subbing layer coating composition a-2 described below was applied so as to form a dried layer thickness of 0.8 μm, which was designated Subbing Layer A-2, while onto Subbing Layer B-1, upper subbing layer coating composition b-2 was applied so as to form a dried layer thickness of 0.8 μm, having a static preventing function, which was designated Subbing Layer B-2.

Upper Subbing Layer Composition a-2

| | |
|---|---|
| Gelatin in amount (weight) to make | 0.4 g/m$^2$ |
| (C-1) | 0.2 g |
| (C-2) | 0.2 g |

-continued

| | |
|---|---|
| (C-3) | 0.2 g |
| Silica particles (average size of 3 μm) | 0.1 g |
| Water to make | 1 liter |

Upper Subbing Layer Composition b-2

| | |
|---|---|
| (C-4) | 60 g |
| Latex solution of (c-5) being ingredient: solid 20 weight % | 80 g |
| Ammonium sulfate | 0.5 g |
| (C-6) | 12 g |
| polyethylene glycol: average molecular weight of 600 | 6 g |
| Water to make | 1 liter |

(C-1)

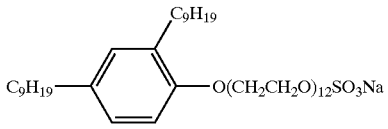

(C-2)

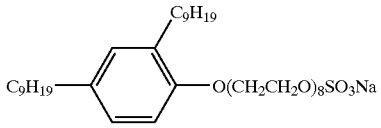

(C-3)

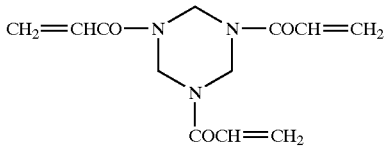

(C-4)

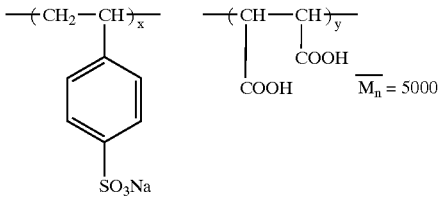

($\overline{Mn}$: average number molecular weight)
x:y = 75:25 (weight ratio)

(C-5)

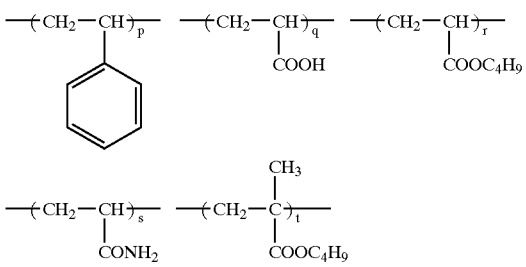

p:q:r:s:t = 40:5:10:5:40 (weight ratio)

-continued (C-6)

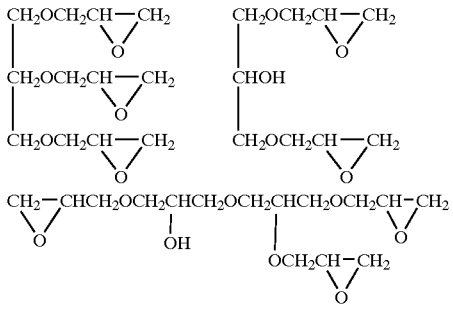

a mixture of the above three compounds

Back Layer-side Coating

To 830 g of methyl ethyl ketone (MEK), 84.2 g of cellulose acetate-butylate CAB381-20, available from Eastman Chemical Co.) and 4.5 g of polyester resin (Vitel PE2200B, available from Bostic Corp.) were added while stirring and dissolved therein. Then, to the resulting solution was added 0.30 g of infrared dye 1, and further, 4.5 g of fluorinated surfactant (Surflon KH40, available from Asahi Glass Co., Ltd.) and 2.3 g of fluorinated surfactant (Megafag F120K, available from DAINIPPON INK Co., Ltd.) which were dissolved in 43.2 g of methanol, and the mixture was stirred until completely dissolved. Then, 75 g of silica (Siloid 64X6000, available from W. R. Grace Corp.), which was dispersed in methyl ethyl ketone at a concentration of 1 wt % using a dissolver type homogenizer, was further added thereto while stirring to obtain coating solution A for a backing layer.

Thus prepared coating solution for said backing layer was coated onto Upper Subbing Layer B-2 with an extrusion coater and dried so as to a have dry thickness of 3.5 μm. Drying was carried out by a flow of air of 100° C. and a dew-point of 10° C. over a period of 5 minutes.

Preparation of Light-sensitive Silver Halide Emulsion 1

| | |
|---|---|
| (A1) | |
| Phenylcarbamoyl gelatin | 88.3 g |
| Compound (A) (10% methanol solution) | 10 ml |
| Potassium bromide | 0.32 g |
| Water to make | 5429 ml |
| (B1) | |
| 0.67 mol/L Aqueous silver nitrate solution | 2635 ml |
| (C1) | |
| Potassium bromide | 51.55 g |
| Potassium iodide | 1.47 g |
| Water to make | 660 ml |
| (D1) | |
| Potassium bromide | 154.9 g |
| Potassium iodide | 4.41 g |
| Iridium chloride (1% solution) | 0.93 ml |
| (E1) | |
| 0.4 mol/L aqueous potassium bromide: Amount necessary to adjust silver potential to following value | |
| (F1) | |
| Acetic acid, 56% aqueous solution | 16.0 ml |

-continued

| (G1) | |
|---|---|
| Anhydrous sodium carbonate | 1.72 g |
| Water to make | 151 ml |

Compound (A):

$$HO(CH_2CH_2O)n—[CH(CH_3)CH_2O]_{17}—(CH_2CH_2O)mH,$$

(m+n ; 5 to 7)

using a stirring mixer described in JP-B Nos. 58-58288, 58-58289, ¼ of solution B1, the total amount of solution C1 were added to solution A1 by double jet addition for 4 minutes and 45 seconds to form nucleus grains, while maintaining a temperature of 45° C. and a pAg of 8.09.

After 7 minutes, ¾ of solution B1 and the total amount of solution D1 were further added by double jet addition for 14 minutes and 15 seconds, while maintaining a temperature of 45° C. and a pAg of 8.09. The pH of the reaction solution was 5.6 during mixing.

After stirring 5 minutes, the reaction mixture temperature was lowered to 40° C. and solution F1 was added thereto to coagulate the resulting halide emulsion. Remaining 2000 ml of precipitates, the supernatant was removed and after adding 10 L of water while stirring, the silver halide emulsion was again coagulated. Remaining 1500 ml of precipitates, the supernatant was removed and after adding 10 L of water while stirring, the silver halide emulsion was again coagulated. Remaining 1500 ml of precipitates, the supernatant was removed and solution G1 was added. The temperature was raised to 60° C. and stirring continued for 120 minutes. Finally, the pH was adjusted to 5.8 and water was added thereto so that the weight per mol of silver was 1161 g.

The resulting emulsion comprised silver iodobromide cubic grains having an average sphere-equivalent grain size of 0.058 μm, a coefficient of variation of grain size of 12% and a [100] face ratio of 92%.

Preparation of Powdered Organic Silver Salt 1

130.8 g of behenic acid, 67.7 g of arachidic acid, 43.6 g of stearic acid, and 2.3 g of palmitic acid were dissolved in 4720 ml of water at 80° C. Then, 540.2 ml of 1.5M aqueous sodium hydroxide solution was added, and after adding 6.9 ml of concentrated nitric acid, the solution was cooled to 55° C. to obtain an organic aqueous acid sodium salt solution. To the above organic aqueous acid sodium solution were added silver halide emulsion 1 obtained above and 450 ml of deionized water, and stirring was further continued for 5 minutes, while maintaining a temperature of 55° C.

Subsequently, 760 ml of 1M aqueous silver nitrate solution was added over 2 minutes. and stirring continued for a further 10 minutes, then, an organic silver salt dispersion was obtained. Thereafter, said obtained organic silver salt dispersion was transferred to a washing vessel and deionized water was added. After stirring and standing, the organic silver salt dispersion rose floated, and the lower aqueous soluble salts were removed. Thereafter, washing with deionized water and drainage were repeated until the drained water reached a conductivity of 2 μS/cm, and after centrifugal drying the obtained organic silver salt was dried at a temperature of 40° C. using a warm forced air circulating drier until to no decrease of weight was reached. Thus, powdered organic silver salt 1 was obtained.

Preparation of Pre-dispersion 1

In 1457 g of MEK was dissolved 14.57 g of polyvinyl butyral powder (Butvar B-79, available from Monsanto Corp.) and further thereto gradually added were 500 g of the above powdered organic silver salt to obtain pre-dispersion 1, while stirring by a dissolver type homogenizer (DISPERMAT Type CA-40, available from VMA-GETZMANN Corp.).

Preparation of Light-sensitive Emulsion 1

Using a pump, pre-dispersion 1 was transferred to a media type dispersion machine (DISPERMAT SL-C12EX, available from VMA-GETZMANN Corp.), which was packed with 1 mm Zirconia beads (TORESELAM, available from Tray Co., Ltd.) at 80% of volume, and dispersed at a mill circumferential rate of 13 m/s and for 10 minutes. of a retention time with a mill to obtain light-sensitive emulsion 1.

Preparation of a Stabilizer Solution

In 4.97 g of methanol, dissolved were 1.0 g of stabilizer 1 and 0.31 g of potassium acetate to obtain a stabilizer solution.

Preparation of Infrared Sensitizing Dye Solution 1

In 31.3 g of MEK, dissolved were in a dark room 19.2 g of infrared sensitizing dye 1, 1.488 g of 2-chloro-benzoic acid, 2.779 g of stabilizer 2 and 365 ml of 5-methyl-2-mercaptobenzimidazole, to obtain infrared sensitizing Dye Solution 1.

Preparation of Additive Solution "a"

In 110 g of MEK were dissolved 27.98 g of 1,1-bis(2-hydroxy-3, 5-dimethylphenyl)-3, 5, 5-trimethylhexane(Rel), 1.54 g of 4-methylphthalic acid and 0.48 g of infrared dye 1 to obtain Additive Solution "a".

Preparation of Additive Solution "b"

In 40.9 g of MEK, dissolved was 3.56 g of antifoggant 2 to obtain Additive Solution "b".

Preparation of Additive Solution "c"

In 5 g of methanol, dissolved was each of silyl compound of the present invention as described in Table 1, of which amount 0.01 mol per 1 mol of silver was contained in the light-sensitive layer coating solution, to obtain Additive Solution "c".

Preparation of Light-sensitive Layer Coating Solution

Light-sensitive emulsion 1 (50 g) and 10.11 g of MEK were maintained at 21° C. while stirring, and after adding 390 μl of anti foggant 1 (10% methanol solution) thereto, the emulsion was stirred for 1 hr. Further thereto, 494 μl of potassium bromide (10% methanol solution) was added and the emulsion was stirred for 10 minutes. Subsequently, 67 ml of stabilizer solution 1 was added and after 10 minutes of stirring, 2.622 g of infrared sensitizing dye solution 1 was added and stirred for 1 hr. Then, the mixture was cooled to 13° C. and stirred for 30 minutes. Further thereto, 13.31 g of polyvinyl butyral (Butvar B-79, available from Monsanto Co.) was added and stirred for 30 minutes, while maintaining a temperature at 13° C. and 1.084 g of tetrachlorophthalic acid (9.4 weight % MEK solution) and stirred for 15 minutes. Then, 12.4 g of Additive Solution "a", 1.6 ml of Desmodur N3300 (aliphatic isocyanate, 10% MEK solution, product of Movey Co.), 4.37 g of Additive Solution "b" and 5.00 g of Additive Solution "cl" were successively added while stirring to obtain coating solutions 1-1 to 1-8 of the light-sensitive layer.

Preparation of Light-sensitive Layer Coating Solution

Light-sensitive layer coating solution 2 was prepared in the same way as preparing light-sensitive layer coating solution 1 except for not adding Additive Solution "c1".

Preparation of Matting Agent Dispersion

In 42.5 g of MEK was dissolved cellulose acetate butyrate (7.5 g of CAB171-15, available from Eastman Chemical Co.) and further thereto, 5 g of potassium carbonate (Super- Pflex 200, available from Speciality Minerals Co.) was added and dispersed using a dissolver type homogenizer at 8000 rpm for 30 minutes. to obtain a matting agent dispersion.

Preparation of a Surface Protective Layer Coating Solution

In 865 g of MEK dissolved were while stirring 96 g of cellulose acetate butyrate (CAB 171-15, available from Eastman Chemical Co.), 4.5 g of polymethyl methacrylic acid (Palaroid A-21, available from Rohm & Haas Co.), 1.5 g of vinylsulfone compound (HD-1), 1.0 g of benzotriazole, 1.0 g of fluorinated surfactant (Surflon KH40, available from Asahi Glass Co., Ltd.), and 8.43 g of phthalazine. Then, 30 g of matting agent dispersion was added while stirring to obtain a coating solution for the surface protective layer.

Coating of the Light-sensitive Layer Side

Each of the viscosities of the above light-sensitive layer coating solutions 1-1 to 1-7 and 2, and the above surface protective layer coating solution were adjusted with an amount of solvent to achieve 0.228 Pa·s and 0.184 Pa·s each, and the coating solutions were filtered through a 200 μm filter at quasi-absolute filtration precision, and then, coated by using an extrusion die-coater which extrudes and forms multiple wet layers, onto the upper subbing layer A-2 on the opposite side of the support coated by the above backing layer, so as to form a layer having light-sensitive coating solution and coated silver content as described in Table 1. 8 seconds later, drying was conducted using 50° C. dried air and at a dew point of 10° C. over a period of 5 minutes. Then, the dried materials were wound up at atmospheric temperature of 23° C. and humidity of 50% RH, and formed rolls with tension of 196 N/m. Finally, the silver salt photothermographic dry imaging materials were prepared. The dry thickness of the surface protective layer of the obtained silver salt photothermographic dry imaging materials was designed to be 25 μm.

Infrared Dye 1

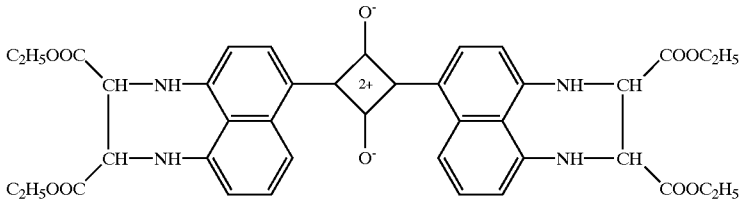

Stabilizer 1

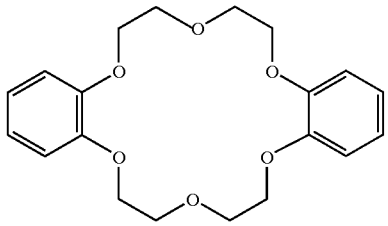

Infrared Sensitizing Dye 1

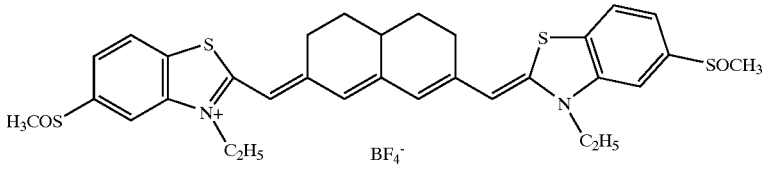

Stabilizer 2

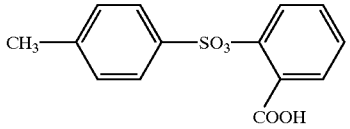

Antifoggant 1

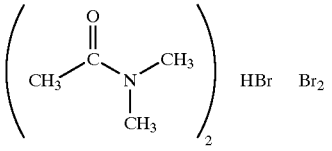

Antifoggant 2

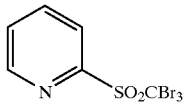

Vinylsulfone compound (HD-1)

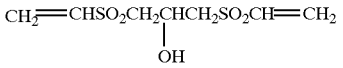

Evaluation of Sensitometry

Thus prepared silver salt photothermographic dry imaging material samples were subjected to laser scanning exposure from the emulsion side, using an exposure apparatus utilizing as a light source a 800 to 820 nm semiconductor laser of a longitudinal multi-mode, which was made by means of high frequency overlapping. The exposure amount to give the maximum densities was arranged so that sample 103 could obtain densities of 3.0 higher than unexposed area. In this case, exposure was conducted at an angle of 75° between the exposed surface and the exposing laser light. (Further, the excellent image quality, such as sharpness, was obtained much beyond the inventor's expectation compared with said angle of 90°.)

The exposed sample was subject to thermal development at 126° C. for 14 seconds., using an automatic developing machine, while bringing the protective layer surface of the silver salt photothermographic dry imaging material into contact with the heated drum surface. Exposure and thermal development were carried out in an atmosphere of 23° C. and 50% RH.

Thus obtained images were measured using a densitometer, and maximum density, fog (max. density and fog included the base density.) and sensitivity (the reciprocal value of exposure amount giving a density of 1.0 above the density of unexposed area) were determined. Further, the sensitivity was represented by a relative value based on the sensitivity of Sample 103 being 100.

Results are shown in Table 1.

TABLE 1

| Sample No. | Silyl compound in the Invention | Light-sensitive Layer Coating Solution No. | Coated Silver Content ($g.m^2$) | Sensi-tivity | Maximum Density | Fog | Remarks |
|---|---|---|---|---|---|---|---|
| 101 | | 2 | 0.8 | 85 | 0.97 | 0.180 | Comp. |
| 102 | | 2 | 1.2 | 89 | 1.50 | 0.185 | Comp. |
| 103 | | 2 | 2.5 | 100 | 3.20 | 0.200 | Comp. |
| 104 | A-1 | 1-1 | 0.7 | 60 | 2.40 | 0.176 | Comp. |
| 105 | A-1 | 1-1 | 0.8 | 90 | 2.95 | 0.178 | Inv. |
| 106 | A-1 | 1-1 | 1.2 | 94 | 3.27 | 0.183 | Inv. |
| 107 | A-1 | 1-1 | 1.5 | 98 | 3.52 | 0.187 | Inv. |
| 108 | A-1 | 1-1 | 2.5 | 110 | 4.40 | 0.198 | Inv. |
| 109 | A-1 | 1-1 | 2.6 | 112 | 4.55 | 0.25 | Comp. |
| 110 | B-1 | 1-2 | 1.5 | 90 | 2.95 | 0.179 | Inv. |
| 111 | B-4 | 1-3 | 0.7 | 65 | 2.50 | 0.176 | Comp. |
| 112 | B-4 | 1-3 | 0.8 | 95 | 3.20 | 0.176 | Inv. |
| 113 | B-4 | 1-3 | 1.2 | 100 | 3.55 | 0.181 | Inv. |
| 114 | B-4 | 1-3 | 1.6 | 104 | 3.87 | 0.186 | Inv. |
| 115 | B-4 | 1-3 | 2.0 | 109 | 4.22 | 0.191 | Inv. |
| 116 | B-4 | 1-3 | 2.5 | 115 | 4.65 | 0.195 | Inv. |
| 117 | B-4 | 1-3 | 2.6 | 118 | 4.83 | 0.252 | Comp. |
| 118 | B-7 | 1-4 | 0.7 | 70 | 2.60 | 0.177 | Comp. |
| 119 | B-7 | 1-4 | 0.8 | 98 | 3.30 | 0.178 | Inv. |
| 120 | B-7 | 1-4 | 1 | 100 | 3.48 | 0.181 | Inv. |
| 121 | B-7 | 1-4 | 1.2 | 102 | 3.66 | 0.184 | Inv. |
| 122 | B-7 | 1-4 | 1.5 | 106 | 3.91 | 0.187 | Inv. |
| 123 | B-7 | 1-4 | 1.8 | 110 | 4.22 | 0.196 | Inv. |
| 124 | B-7 | 1-4 | 2.5 | 118 | 4.85 | 0.201 | Inv. |
| 125 | B-7 | 1-4 | 2.6 | 118 | 5.04 | 0.268 | Comp. |
| 126 | B-9 | 1-5 | 1.5 | 90 | 2.93 | 0.178 | Inv. |
| 127 | B-12 | 1-6 | 1.5 | 90 | 3.25 | 0.179 | Inv. |
| 128 | B-15 | 1-7 | 0.7 | 65 | 2.50 | 0.176 | Comp. |
| 129 | B-15 | 1-7 | 0.8 | 95 | 3.20 | 0.178 | Inv. |
| 130 | B-15 | 1-7 | 1.2 | 100 | 3.54 | 0.183 | Inv. |
| 131 | B-15 | 1-7 | 1.5 | 103 | 3.80 | 0.187 | Inv. |
| 132 | B-15 | 1-7 | 2.5 | 115 | 4.65 | 0.199 | Inv. |
| 133 | B-15 | 1-7 | 2.6 | 117 | 4.85 | 0.255 | Comp. |
| 134 | B-21 | 1-8 | 0.7 | 66 | 2.55 | 0.175 | Comp. |
| 135 | B-21 | 1-8 | 0.8 | 97 | 3.10 | 0.177 | Inv. |
| 136 | B-21 | 1-8 | 1.2 | 102 | 3.43 | 0.182 | Inv. |
| 137 | B-21 | 1-8 | 1.5 | 105 | 3.72 | 0.186 | Inv. |
| 138 | B-21 | 1-8 | 2.5 | 116 | 4.55 | 0.198 | Inv. |
| 139 | B-21 | 1-8 | 2.6 | 119 | 4.88 | 0.256 | Comp. |

Comp.: Comparative sample
Inv.: Inventive sample

As is apparent from Table 1, it was proved that samples according to the present invention exhibited higher maximum densities and lower fog densities compared to the comparative samples. Further, it was also proved that samples of the present invention exhibited the maximum densities of about 3.0 even the silver coverage were decreased to 0.8 g/m2, and thus, indicated a possibility of a practical usage in medical field was proved. And furthermore, the samples of the present invention accomplished the maximum densities of about 4.5 with 2.5 g/m2 of silver coverage, and this indicated the effectiveness in graphic arts plate making.

EXAMPLE 2

Preparation of Light-sensitive Silver Halide Emulsion 2

Light-sensitive silver halide emulsion 2 was obtained in the same way as preparing light-sensitive silver halide emulsion 1 except for the mixing temperature of 20° C. instead of 45° C. and the adding time to form nucleus grains changed to 20 seconds from 4 minutes and 45 seconds. This emulsion comprised silver iodobromide cubic grains having an average sphere-equivalent grain size of 0.0095 $\mu$m, a coefficient of variation of grain size of 18% and a [100] face ratio of 92%.

Preparation of Powdered Organic Silver Salt 2

Powdered organic silver salt 2 was prepared in the same way as preparing powdered organic silver salt 1, except that light-sensitive silver halide emulsion 1 was replaced with light-sensitive silver halide emulsion 2.

Preparation of Pre-dispersion 2

Pre-dispersion 2 was prepared in the same way as pre-dispersion 1, except that powdered organic silver salt 1 was replaced with powdered organic silver salt 2.

Preparation of Light-sensitive Emulsion 2

Light-sensitive Emulsion 2 was prepared in the same way as light-sensitive emulsion 1, except that pre-dispersion 1 was replaced with pre-dispersion 2.

Preparation of Additive Solution "c2"

In 5 g of methanol, dissolved was silyl compound of the present invention as described in Table 2, of which amount 0.01 mol per 1 mol of silver was contained in the light-sensitive layer coating solution, to obtain Additive Solution "c2".

Preparation of Light-sensitive Layer Coating Solution

Light-sensitive layer coating solutions 3-1 to 3-5 were prepared in the same way as light-sensitive layer coating solution 1, except that light-sensitive emulsion 1 was replaced with light-sensitive emulsion 2 and/or Additive Solution "cl" was replaced with Additive Solution "c2".

Preparation of Light-sensitive Layer Coating Solution

Light-sensitive layer coating solution 4 was prepared in the same way as light-sensitive layer coating solution 3, except that Additive Solution "c2" was not added.

Preparation of Light-sensitive Silver Halide Emulsion

Light-sensitive silver halide emulsion 3 was prepared in the same way as light-sensitive silver halide emulsion 1 of Example 1, except that the mixing temperature was changed to 30° C. from 45° C. and the adding time to form nucleus grains to 24 seconds from 4 minutes and 45 seconds. This emulsion comprised silver iodobromide cubic grains having an average sphere-equivalent grain size of 0.020 μm, a coefficient of variation of grain size of 13% and a [100] face ratio of 92%.

Preparation of Powdered Organic Silver Salt 3

Powdered organic silver salt 3 was prepared in the same way as powdered organic silver salt 1 of Example 1, except that light-sensitive silver halide emulsion 1 was replaced with light-sensitive silver halide emulsion 3.

Preparation of Pre-dispersion 3

Pre-dispersion 3 was prepared in the same way as pre-dispersion 1 of Example 1, except that powdered organic silver salt 1 was replaced with powdered organic silver salt 3.

Preparation of Light-sensitive Emulsion 3

Light-sensitive emulsion 3 was prepared in the same way as light-sensitive emulsion 1 of Example 1, except that pre-dispersion 1 was replaced with pre-dispersion 3.

Preparation of Light-sensitive Layer Coating Solution

Light-sensitive layer coating solutions 5-1 to 5-5 were prepared in the same way as light-sensitive layer coating solution 1 of Example 1, except that light-sensitive emulsion 1 was replaced with light-sensitive emulsion 3 and/or Additive Solution "c1" was replaced with Additive Solution "c2".

Preparation of Light-sensitive Layer Coating Solution

Light-sensitive layer coating solution 6 was prepared in the same way as light-sensitive layer coating solution 5, except that Additive Solution "c2" was not added.

Preparation of Light-sensitive Silver Halide Emulsion 4

Light-sensitive silver halide emulsion 4 was prepared in the same way as light-sensitive silver halide emulsion 1 of Example 1, except that the mixing temperature was changed to 38° C. from 45° C. and the adding time to form nucleus grains to 24 seconds from 4 minutes and 45 seconds. This emulsion comprised silver iodobromide cubic grains having an average sphere-equivalent grain size of 0.030 μm, a coefficient of variation of grain size of 12% and a [100] face ratio of 92%.

Preparation of Powdered Organic Silver Salt 4

Powdered organic silver salt 4 was prepared in the same way as powdered organic silver salt 1 of Example 1, except that light-sensitive silver halide emulsion 1 was replaced with light-sensitive silver halide emulsion 4.

Preparation of Pre-dispersion 4

Pre-dispersion 4 was prepared in the same way as pre-dispersion 1 of Example 1, except that powdered organic silver salt 1 was replaced with powdered organic silver salt 4.

Preparation of Light-sensitive Emulsion 4

Light-sensitive emulsion 4 was prepared in the same way as light-sensitive emulsion 1 of Example 1, except that pre-dispersion 1 was replaced with pre-dispersion 4.

Preparation of Light-sensitive Layer Coating Solution

Light-sensitive layer coating solutions 7-1 to 7-5 were prepared in the same way as light-sensitive layer coating solution 1 of Example 1, except that light-sensitive emulsion 1 was replaced with light-sensitive emulsion 4 and/ or Additive Solution "c1" was replaced with Additive Solution "c2".

Preparation of Light-sensitive Layer Coating Solution

Light-sensitive layer coating solution 8 was prepared in the same way as light-sensitive layer coating solution 7, except that Additive Solution "c2" was not added.

Preparation of Light-sensitive Silver Halide Emulsion 5

Light-sensitive silver halide emulsion 5 was prepared in the same way as light-sensitive silver halide emulsion 1 of Example 1, except that the mixing temperature was changed to 47° C. from 45° C. and the adding time to form nucleus grains to 15 minutes from 4 minutes and 45 seconds. This emulsion comprised silver iodobromide cubic grains having an average sphere-equivalent grain size of 0.080 μm, a coefficient of variation of grain size of 12% and a [100] face ratio of 92%.

Preparation of Powdered Organic Silver Salt 5

Powdered organic silver salt 5 was prepared in the same way as powdered organic silver salt 1 of Example 1, except that light-sensitive silver halide emulsion 1 was replaced with light-sensitive silver halide emulsion 5.

Preparation of Pre-dispersion 5

Pre-dispersion 5 was prepared in the same way as pre-dispersion 1 of Example 1, except that powdered organic silver salt 1 was replaced with powdered organic silver salt 5.

Preparation of Light-sensitive Emulsion 5

Light-sensitive emulsion 5 was prepared in the same way as light-sensitive emulsion 1 of Example 1, except that pre-dispersion 1 was replaced with pre-dispersion 5.

Preparation of Light-sensitive Layer Coating Solution

Light-sensitive layer coating solutions 9-1 to 9-6 were prepared in the same way as light-sensitive layer coating solution 1 of Example 1, except that light-sensitive emulsion 1 was replaced with light-sensitive emulsion 5 and/or Additive Solution "c1" was replaced with Additive Solution "c2".

Preparation of Light-sensitive Layer Coating Solution

Light-sensitive layer coating solution 10 was prepared in the same way as light-sensitive layer coating solution 9, except that Additive Solution "c2" was not added.

Preparation of Light-sensitive Silver Halide Emulsion 6

Light-sensitive silver halide emulsion 6 was prepared in a same way as light-sensitive silver halide emulsion 1 of Example 1, except that the mixing temperature was changed to 50° C. from 45° C. and the adding time to form nucleus grains to 15 minutes from 4 minutes and 45 seconds. This emulsion comprised silver iodobromide cubic grains having an average sphere-equivalent grain size of 0.110 μm, a coefficient of variation of grain size of 12% and a [100] face ratio of 92%.

Preparation of Powdered Organic Silver Salt 6

Powdered organic silver salt 6 was prepared in the same way as powdered organic silver salt 1 of Example 1, except that light-sensitive silver halide emulsion 1 was replaced with light-sensitive silver halide emulsion 6.

Preparation of Pre-dispersion 6

Pre-dispersion 6 was prepared in the same way as pre-dispersion 1 of Example 1, except that powdered organic silver salt 1 was replaced with powdered organic silver salt 6.

Preparation of Light-sensitive Emulsion 6

Light-sensitive Emulsion 6 was prepared in the same way as light-sensitive emulsion 1 of Example 1, except that pre-dispersion 1 was replaced with pre-dispersion 6.

Preparation of Light-sensitive Layer Coating Solution

Light-sensitive layer coating solutions 11-1 to 11-5 were prepared in the same way as light-sensitive layer coating solution 1 of Example 1, except that light-sensitive emulsion 1 was replaced with light-sensitive emulsion 6 and/or Additive Solution "c1" was replaced with Additive Solution "c2".

Preparation of Light-sensitive Layer Coating Solution

Light-sensitive layer coating solution 12 was prepared in the same way as light-sensitive layer coating solution 11, except that Additive Solution "c2" was not added.

Preparation of Light-sensitive Silver Halide Emulsion 7

Light-sensitive silver halide emulsion 7 was prepared in the same way as light-sensitive silver halide emulsion 1 of Example 1, except that the mixing temperature was changed to 52° C. from 45° C. and the adding time to form nucleus grains to 25 minutes from 4 minutes and 45 seconds. This emulsion comprised silver iodobromide cubic grains having an average sphere-equivalent grain size of 0.160 μm, a coefficient of variation of grain size of 12% and a [100] face ratio of 92%.

Preparation of Powdered Organic Silver Salt 7

Powdered organic silver salt 7 was prepared in the same way as powdered organic silver salt 1 of Example 1, except that light-sensitive silver halide emulsion 1 was replaced with light-sensitive silver halide emulsion 7.

Preparation of Pre-dispersion 7

Pre-dispersion 7 was prepared in the same way as pre-dispersion 1 of Example 1, except that powdered organic silver salt 1 was replaced with powdered organic silver salt 7.

Preparation of Light-sensitive Emulsion 7

Light-sensitive Emulsion 7 was prepared in the same way as light-sensitive emulsion 1 of Example 1, except that pre-dispersion 1 was replaced with pre-dispersion 7.

Preparation of Light-sensitive Layer Coating Solution 13

Light-sensitive layer coating solutions 13-1 to 13-5 were prepared in the same way as light-sensitive layer coating solution 1 of Example 1, except that light-sensitive emulsion 1 was replaced with light-sensitive emulsion 7 and/or Additive Solution "c1" was replaced with Additive Solution "c2".

Preparation of Light-sensitive Layer Coating Solution 14

Light-sensitive layer coating solution 14 was prepared in the same way as light-sensitive layer coating solution 13, except that Additive Solution "c2" was not added.

Preparation of Light-sensitive Layer Coating Solution 15

Light-sensitive layer coating solutions 15-1 to 15-5 were prepared in the same way as light-sensitive layer coating solution 1 of Example 1, except that light-sensitive emulsion 1 (50 g) was replaced with light-sensitive emulsion 4 (25 g) and light-sensitive emulsion 5 (25 g) and/or Additive Solution "c1" was replaced with Additive Solution "c2".

Preparation of Light-sensitive Layer Coating Solution 16

Light-sensitive layer coating solution 16 was prepared in the same way as light-sensitive layer coating solution 15, except that Additive Solution "c2" was not added.

Preparation of Light-sensitive Layer Coating Solution 17

Light-sensitive layer coating solution 17-1 to 17-5 were prepared in the same way as light-sensitive layer coating solution 1 of Example 1, except that Additive Solution "c2" was used in place of Additive Solution "c1" that was used for the light-sensitive layer coating solution 1.

Preparation of Light-sensitive Layer Coating Solution 18

Light-sensitive layer coating solution 18 was prepared in the same way as light-sensitive layer coating solution 17, except that Additive Solution "c2" was not added. Preparation of Silver Salt Photothermographic Dry Imaging Material Coating of Light-sensitive Layer Side Each of the viscosities of the above light-sensitive layer coating solutions 3 to 16 and the surface protective layer coating solution were adjusted with an amount of solvent to achieve 0.228 Pa·s and 0.184 Pa·s each, and the coating solutions were filtered through a 200 μm filter at quasi-absolute filtration precision, and then, coated by using an extrusion die-coater which extrudes and forms multiple wet layers, onto the upper subbing layer A-2 on the opposite side of the support coated by the backing layer described in Example 1, so as to form a layer having light-sensitive coating solution and coated silver content as described in Table 2. Further, 8 seconds later, drying was conducted using 75° C. dried air and at a dew point of 10° C. over a period of 5 minutes. Then, the dried materials were wound up at atmospheric temperature of 23° C. and humidity of 50% RH, and formed rolls with tension of 196 N/m. Finally, the silver salt photothermographic dry imaging materials were prepared. The coated silver content and the dry thickness of the surface protective layer of the obtained silver salt photothermographic dry imaging materials were 1.2 g/m$^2$ and 25 μm.

Evaluation of Sensitometry

Evaluation of sensitometry was performed in the same way as that of Example 1, except that the exposure amount to give the maximum densities was determined so that sample 144 could obtain densities of 3.0 higher than an unexposed area. (When exposure was conducted at an angle of 75° between the exposed surface and the exposing laser light, the excellent image quality, such as sharpness, was obtained much beyond the inventor's expectation compared with said angle of 90°.)

The thus obtained images were measured using a densitometer, and maximum density, fog (max. density and fog included the base density.) and sensitivity (the reciprocal value of exposure giving a density of 1.0 above the minimum density (Dm)) were determined. Further, the sensitivity was represented by a relative value based on the sensitivity of Sample 144 being 100, and the obtained results were shown in Table 2.

TABLE 2

| Sample No. | Silyl compound in the Invention | Light-sensitive Layer Coating Solution No. | Silver Halide Grain Size (μm) | Sensitivity | Maximum Density | Fog | Remarks |
|---|---|---|---|---|---|---|---|
| 140 | | 4 | 0.0095 | 25 | 0.8 | 0.177 | Comp. |
| 141 | | 6 | 0.020 | 50 | 2.6 | 0.178 | Comp. |

TABLE 2-continued

| Sample No. | Silyl compound in the Invention | Light-sensitive Layer Coating Solution No. | Silver Halide Grain Size (μm) | Sensitivity | Maximum Density | Fog | Remarks |
|---|---|---|---|---|---|---|---|
| 142 | | 8 | 0.030 | 70 | 3.19 | 0.185 | Comp. |
| 143 | | 18 | 0.058 | 89 | 1.50 | 0.185 | Comp. |
| 144 | | 10 | 0.080 | 100 | 1.90 | 0.220 | Comp. |
| 145 | | 12 | 0.110 | 115 | 1.50 | 0.240 | Comp. |
| 146 | | 14 | 0.160 | 125 | 1.20 | 0.380 | Comp. |
| 147 | | 16 | Mixture of 0.030 and 0.080 | 85 | 2.50 | 0.203 | Comp. |
| 148 | A-1 | 3-1 | 0.0095 | 30 | 1.20 | 0.178 | Comp. |
| 149 | A-1 | 5-1 | 0.020 | 72 | 3.58 | 0.179 | Inv. |
| 150 | A-1 | 7-1 | 0.030 | 77 | 4.38 | 0.182 | Inv. |
| 151 | A-1 | 17-1 | 0.058 | 94 | 3.27 | 0.183 | Inv. |
| 152 | A-1 | 9-1 | 0.080 | 110 | 3.35 | 0.217 | Inv. |
| 153 | A-1 | 11-1 | 0.110 | 120 | 3.02 | 0.227 | Inv. |
| 154 | A-1 | 13-1 | 0.160 | 125 | 2.42 | 0.271 | Comp. |
| 155 | A-1 | 15-1 | Mixture of 0.030 and 0.080 | 95 | 3.87 | 0.198 | Inv. |
| 156 | B-1 | 9-2 | 0.080 | 110 | 3.38 | 0.216 | Inv. |
| 157 | B-1 | 15-2 | Mixture of 0.030 and 0.080 | 94 | 4.17 | 0.199 | Inv. |
| 158 | B-4 | 3-2 | 0.0095 | 45 | 1.70 | 0.177 | Comp. |
| 159 | B-4 | 5-2 | 0.020 | 73 | 3.81 | 0.178 | Inv. |
| 160 | B-4 | 7-2 | 0.030 | 78 | 4.68 | 0.180 | Inv. |
| 161 | B-4 | 17-2 | 0.058 | 100 | 3.55 | 0.181 | Inv. |
| 162 | B-4 | 9-3 | 0.080 | 112 | 3.65 | 0.215 | Inv. |
| 163 | B-4 | 11-2 | 0.110 | 120 | 3.25 | 0.226 | Inv. |
| 164 | B-4 | 13-2 | 0.160 | 127 | 2.48 | 0.264 | Comp. |
| 165 | B-4 | 15-3 | Mixture of 0.030 and 0.080 | 98 | 3.87 | 0.196 | Inv. |
| 166 | B-7 | 3-3 | 0.0095 | 50 | 1.75 | 0.178 | Comp. |
| 167 | B-7 | 5-3 | 0.020 | 77 | 3.91 | 0.179 | Inv. |
| 168 | B-7 | 7-3 | 0.030 | 82 | 4.72 | 0.181 | Inv. |
| 169 | B-7 | 17-3 | 0.058 | 102 | 3.66 | 0.184 | Inv. |
| 170 | B-7 | 9-4 | 0.080 | 115 | 3.68 | 0.217 | Inv. |
| 171 | B-7 | 11-3 | 0.110 | 123 | 3.31 | 0.225 | Inv. |
| 172 | B-7 | 13-3 | 0.160 | 129 | 2.52 | 0.287 | Comp. |
| 173 | B-15 | 3-4 | 0.0095 | 55 | 1.60 | 0.178 | Comp. |
| 174 | B-15 | 5-4 | 0.020 | 80 | 3.74 | 0.180 | Inv. |
| 175 | B-15 | 7-4 | 0.030 | 85 | 4.53 | 0.181 | Inv. |
| 176 | B-15 | 17-4 | 0.058 | 100 | 3.54 | 0.183 | Inv. |
| 177 | B-15 | 9-5 | 0.080 | 116 | 3.56 | 0.218 | Inv. |
| 178 | B-15 | 11-4 | 0.110 | 125 | 3.21 | 0.228 | Inv. |
| 179 | B-15 | 13-4 | 0.160 | 131 | 2.51 | 0.297 | Comp. |
| 180 | B-15 | 15-4 | Mixture of 0.030 and 0.080 | 102 | 4.17 | 0.198 | Inv. |
| 181 | B-21 | 3-5 | 0.0095 | 55 | 1.65 | 0.178 | Comp. |
| 182 | B-21 | 5-5 | 0.020 | 80 | 3.73 | 0.180 | Inv. |
| 183 | B-21 | 7-5 | 0.030 | 85 | 4.53 | 0.182 | Inv. |
| 184 | B-21 | 17-5 | 0.058 | 102 | 3.43 | 0.182 | Inv. |
| 185 | B-21 | 9-6 | 0.080 | 114 | 3.60 | 0.216 | Inv. |
| 186 | B-21 | 11-5 | 0.110 | 124 | 3.25 | 0.227 | Inv. |
| 187 | B-21 | 13-5 | 0.160 | 130 | 2.48 | 0.301 | Comp. |
| 188 | B-21 | 15-5 | Mixture of 0.030 and 0.080 | 100 | 3.87 | 0.199 | Inv. |

Comp.: Comparative sample,
Inv.: Inventive sample

As is apparent from Table 2, it was proved that samples according to the present invention exhibited higher maximum densities and lower fog densities compared to the comparative samples. Further, it was also proved that higher maximum densities were obtained without lowering sensitivity by using smaller size silver halide grains, and higher sensitivity and also higher maximum densities were obtained by using larger size silver halide grains. Also, it was proved that the silver salt photothermographic dry imaging material having preferable sensitivity and higher maximum densities could be obtained by using a mixture of different sizes of silver halide.

EXAMPLE 3

Preparation of Light-sensitive Layer Coating Solution 19

Light-sensitive emulsion 1 (50 g) as described in Example 1 and 10.11 g of MEK were maintained at 21° C. while stirring, and after adding 390 μl of antifoggant 1 (10% methanol solution) thereto, the emulsion was stirred for 1 hr. Further thereto, 494 μl of potassium bromide (10% methanol solution) was added and the emulsion was stirred for 30 minutes. Subsequently, 67 ml of stabilizer solution 2 was added and after 10 minutes stirring, 2.622 g of infrared sensitizing dye solution 1 was added and stirred for 50 minutes. Then, 1.3 g of a compound (as a methanol solution of 0.29 weight %) used in the present invention and represented by Formula (1) and described in Table 3, was added to the above solution, and after 10 minutes, the mixture was cooled to 13° C. and stirred for 30 minutes. Further thereto, 15.97 g of polyvinyl butyral (Butvar B-79, available from Monsanto Co.) was added and stirred for 30 minutes, while maintaining the temperature at 13° C. and 1.301 9 of tetrachlorophthalic acid (9.4 weight % MEK solution) was added and stirred for 15 minutes. Then, 14.92 g of Additive Solution "a", 1.6 ml of Desmodur N3300 (aliphatic isocyanate, 10% MEK solution, product of Movey Co.), 4.27 g of Additive Solution "b" and 5.00 g of Additive Solution "c1" described below were successively added while stirring, to obtain coating solutions 19-1 to 19-12 of the light-sensitive layer.

Preparation of Additive Solution "c3"

In 5 g of methanol, was dissolved each of silyl compound of the present invention as described in Table 3, of which amount 0.01 mol per 1 mol of silver was contained in the light-sensitive layer coating solution, to obtain Additive Solution "c3".

Preparation of Infrared Sensitizing Dye Solution 2

In 31.3 g of MEK, dissolved were in a dark room 19.2 g of infrared sensitizing dye 1, 1.488 g of 2-chloro-benzoic acid and 2.779 g of stabilizer 2, to obtain an infrared sensitizing dye solution 2.

Preparation of Light-sensitive Layer Coating Solution 20

Light-sensitive layer coating solutions 20-1 and 20-2 were prepared in the same way as light-sensitive layer coating solution 17, except that Additive Solution "c3" was not added.

Preparation of Silver Salt Photothermographic Dry Imaging Material

Coating of Light-sensitive Layer Side

Each of the viscosities of light-sensitive layer coating solutions of Example 1 of 1-1 to 1-4, 1-7, 1-8 and 2 and above 19-1 to 19-12, 20-1 and 20-2, and the surface protective layer coating solution were adjusted with an amount of solvent to achieve 0.228 Pa·s and 0.184 Pa·s each, and the coating solutions were filtered through a 200 μm filter at quasi-absolute filtration precision, and then, coated by using an extrusion die-coater which extrudes and forms multiple wet layers, onto the upper subbing layer A-2 on the opposite side of the support coated by the backing layer as described in Example 1, so as to form a layer having light-sensitive coating solution and coated silver content as described in Table 3. Further, 8 seconds later, drying was conducted using 75° C. dried air and at a dew point of 10° C. over a period of 5 minutes. Then, the dried materials were wound up at atmospheric temperature of 23° C. and humidity of 50% RH, and formed rolls with tension of 196 N/m. Finally, the silver salt photothermographic dry imaging materials were prepared. The coated silver content and the dry thickness of the surface protective layer of the obtained silver salt photothermographic dry imaging materials were 1.2 g/m$^2$ and 25 μm.

Evaluation of Sensitometry

Evaluation of sensitometry was performed in the same way as that of Example 1, except that the exposure amount to give the maximum densities was determined so that sample 190 could obtain densities of 3.0 higher than an unexposed area. (When exposure was conducted at an angle of 75° between the exposed surface and the exposing laser light, the excellent image quality, such as sharpness, was obtained much beyond the inventor's expectation compared with said angle of 90°.)

The thus obtained images were measured using a densitometer, and maximum density, fog (max. density and fog included the base density.) and sensitivity (the reciprocal value of exposure giving a density of 1.0 above the density of unexposed area) were determined. Further, the sensitivity was represented by a relative value based on the sensitivity of Sample 190 being 100.

Results are shown in Table 3.

TABLE 3

| Sample No. | Silyl compound in the Invention | Compound of Formula (1) | Light-sensitive Layer Coating Solution No. | Sensitivity | Maximum Density | Fog | Remarks |
|---|---|---|---|---|---|---|---|
| 189 | — | — | 2 | 85 | 2.75 | 0.185 | Comp. |
| 190 | — | 1-21 | 18-1 | 100 | 3.19 | 0.184 | Comp. |
| 191 | — | 1-23 | 18-2 | 97 | 3.15 | 0.187 | Comp. |
| 192 | A-1 | — | 1-1 | 95 | 3.78 | 0.183 | Inv. |
| 193 | B-1 | — | 1-2 | 95 | 3.81 | 0.184 | Inv. |
| 194 | B-4 | — | 1-3 | 100 | 4.04 | 0.182 | Inv. |
| 195 | B-7 | — | 1-4 | 102 | 4.18 | 0.188 | Inv. |
| 196 | B-15 | — | 1-7 | 98 | 3.97 | 0.184 | Inv. |
| 197 | B-21 | — | 1-8 | 99 | 3.91 | 0.183 | Inv. |
| 198 | A-1 | 1-21 | 17-1 | 105 | 4.40 | 0.181 | Inv. |
| 199 | B-1 | 1-21 | 17-2 | 106 | 4.43 | 0.182 | Inv. |
| 200 | B-4 | 1-21 | 17-3 | 112 | 4.70 | 0.179 | Inv. |
| 201 | B-7 | 1-21 | 17-4 | 115 | 4.95 | 0.185 | Inv. |
| 202 | B-15 | 1-21 | 17-5 | 110 | 4.61 | 0.181 | Inv. |
| 203 | B-21 | 1-21 | 17-6 | 108 | 4.55 | 0.181 | Inv. |
| 204 | A-1 | 1-23 | 17-7 | 104 | 4.34 | 0.181 | Inv. |
| 205 | B-1 | 1-23 | 17-8 | 105 | 4.37 | 0.182 | Inv. |
| 206 | B-4 | 1-23 | 17-9 | 111 | 4.64 | 0.179 | Inv. |
| 207 | B-7 | 1-23 | 17-10 | 114 | 4.93 | 0.186 | Inv. |
| 208 | B-15 | 1-23 | 17-11 | 109 | 4.55 | 0.181 | Inv. |
| 209 | B-21 | 1-23 | 17-12 | 107 | 4.49 | 0.181 | Inv. |

Comp.: Comparative sample,
Inv.: Inventive sample

As is apparent from Table 3, it was proved that samples according to the present invention exhibited higher maximum densities and lower fog densities compared to the comparative samples. Further, it was also proved that samples 198 to 209 (compositions of item 4 of the present invention) were particularly superior.

Based on the present invention, it is possible to provide a silver salt photothermographic dry imaging material having high maximum densities, high sensitivity and low fog density, and an image recording method and an image forming method using said silver salt photothermographic dry imaging material.

What is claimed is:

1. A photothermographic imaging material comprising a support having thereon a photosensitive layer comprising a photosensitive silver halide, a light-insensitive organic silver salt, a binder, a cross-linking agent having at least two isocyanate groups and a reducing agent for silver ions.

2. The photothermographic imaging material of claim 1, wherein the photosensitive layer has a silver coverage of 0.8 to 1.6 g/m$^2$.

3. The photothermographic imaging material of claim 1, wherein Z in Formula (B) represents $OR^{21}$, $R^{21}$ containing at least two selected from the group consisting of primary and secondary amino groups.

4. The photothermographic imaging material of claim 1, wherein the compound represented by Formula (A) or Formula (B) is present in an amount of $1\times10^{-4}$ to 1 mol per mol of silver.

5. The photothermographic imaging material of claim 4, wherein the compound represented by Formula (A) or Formula (B) is selected from the group consisting of:

A-1

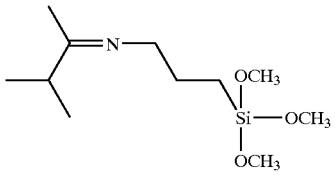

A-2

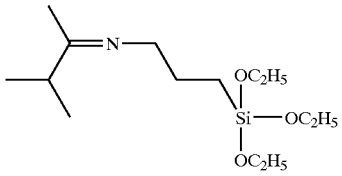

A-3

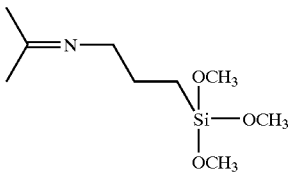

A-4

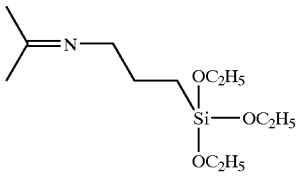

A-5

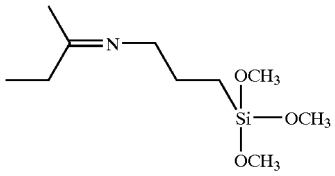

-continued

A-6

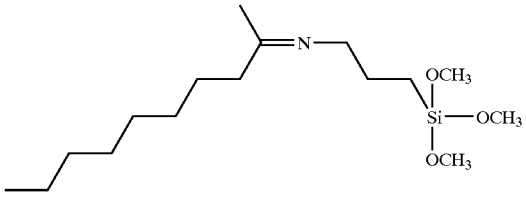

A-7

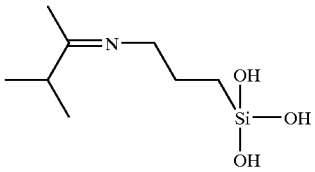

A-8

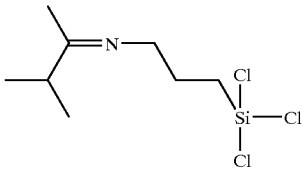

B-1

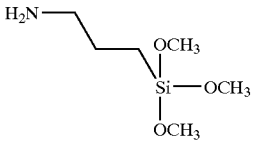

B-2

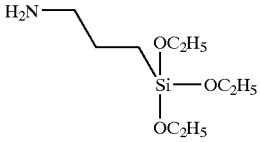

B-3

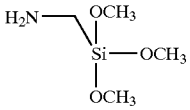

B-4

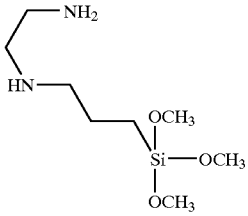

B-5

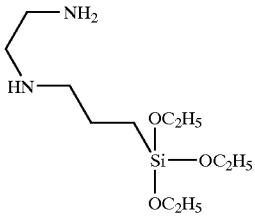

-continued
B-6
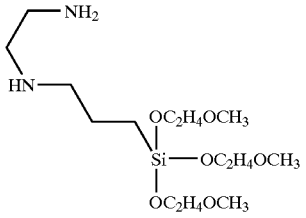
B-7
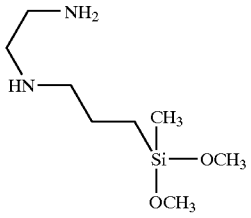
B-8
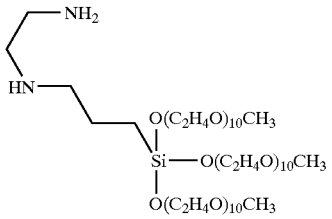
B-9
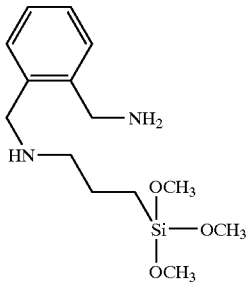
B-10
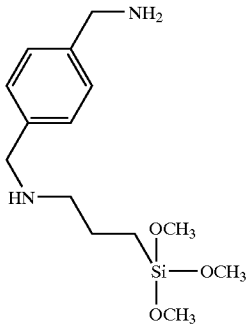
B-11
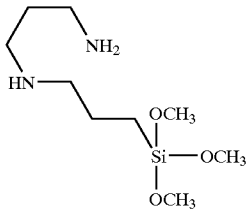
-continued
B-12
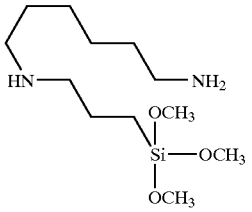
B-13
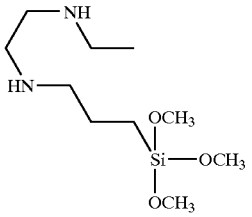
B-14
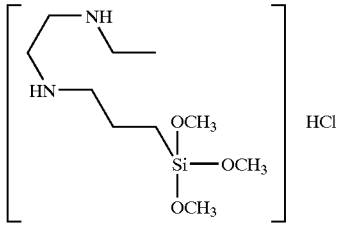
B-15
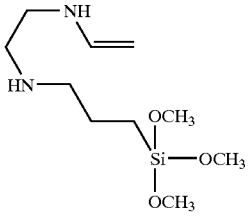
B-16
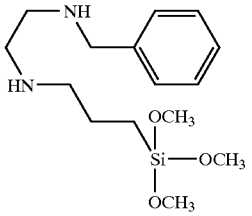
B-17
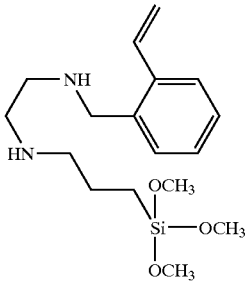
B-18
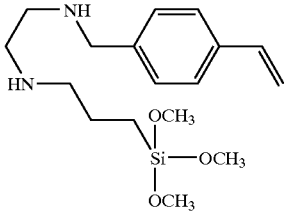

-continued
B-19
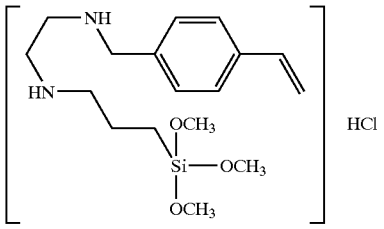
B-20
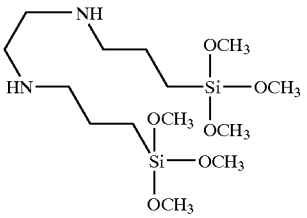
B-21
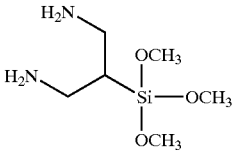
B-22
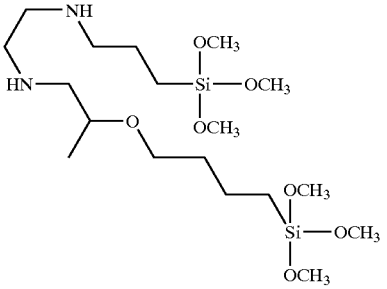
B-23
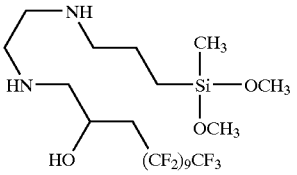
B-24
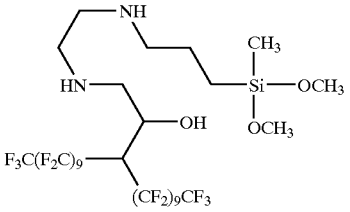
B-25
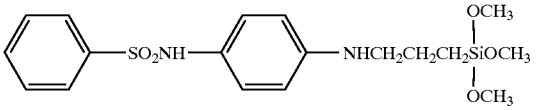
B-26
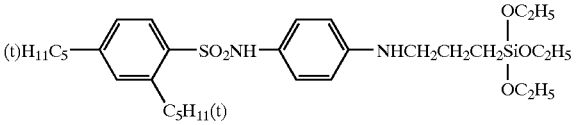
-continued
B-27
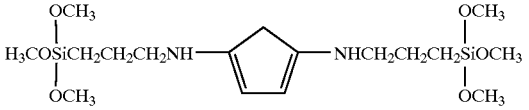
B-28
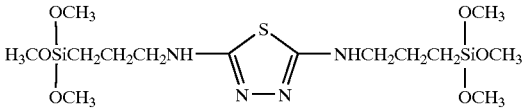
B-29
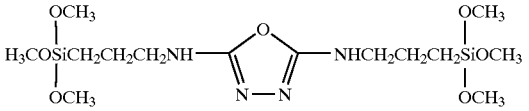
B-30
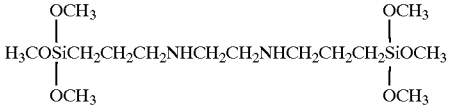
B-31
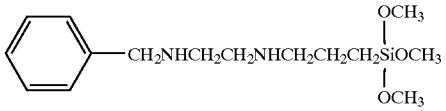
B-32
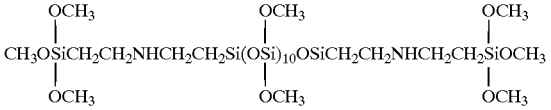
B-33
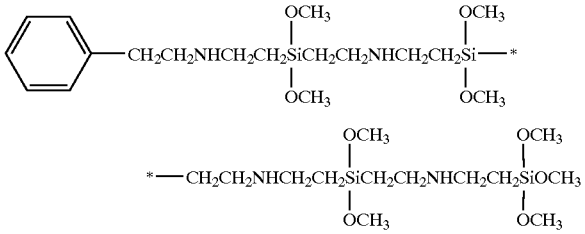
B-34
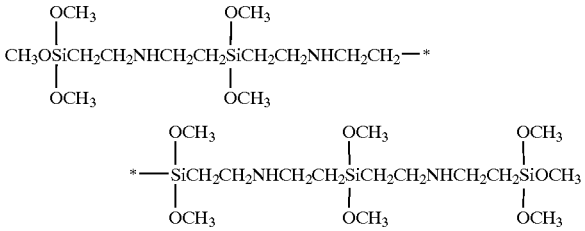
B-35
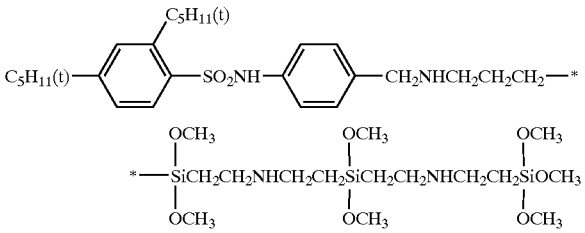

-continued

B-36

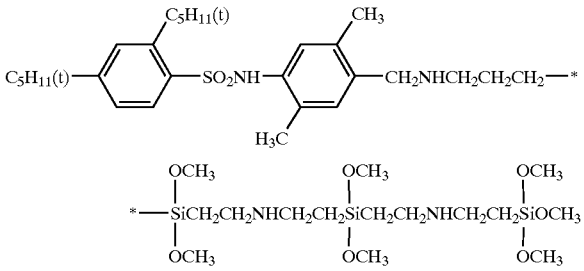

B-37

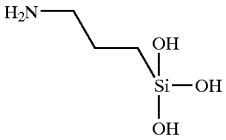

B-38

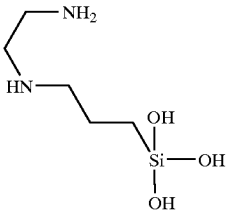

B-39

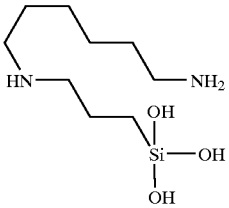

B-40

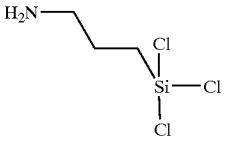

B-41

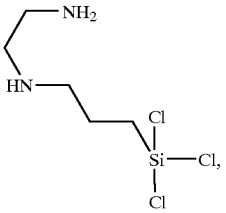

and

B-42

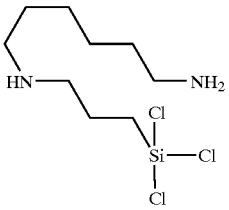

wherein the photosensitive layer has a silver coverage of 0.8 to 2.5 g/m$^2$, and the photosensitive layer comprises a compound represented by Formula (A) or Formula (B):

Formula (A),

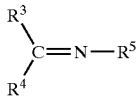

wherein each $R^3$, $R^4$ and $R^5$ is independently an alkyl group, an alkenyl group, an alkynyl group, an aryl group or a heterocyclic group, provided that $R^5$ includes a group represented by Formula (α):

Formula (α),

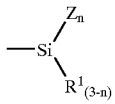

wherein Z represents $OR^2$, X, or OH; n is an integer of 1 to 3; each $R^1$ and $R^2$ is independently an alkyl group an alkenyl group, an alkynyl group, an aryl group or a heterocyclic group; and X is a chlorine atom or a bromine atom, Formula (B),

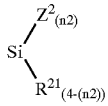

wherein $Z^2$ is $OR^{22}$, $X^2$, or OH; (n2)is an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two groups selected from the group consisting of primary and secondary amino groups; and $X^2$ is a chlorine atom or a bromine atom.

6. An image recording method, comprising a step of:

exposing the photothermographic imaging material of claim 1 with a laser beam using a laser scanning exposure apparatus, wherein the photothermographic imaging material is exposed not substantially vertical to a surface of the photothermographic imaging material.

7. An image recording method, comprising a step of:

exposing the photothermographic imaging material of claim 1 with a laser beam using a laser scanning exposure apparatus, wherein the photothermographic imaging material is exposed using a longitudinal multiple scanning method.

8. An image recording method, comprising a step of:

exposing the photothermographic imaging material of claim 1 with a laser beam using a laser scanning exposure apparatus, wherein the photothermographic imaging material is exposed not substantially vertical to a surface of the photothermographic imaging material using a longitudinal multiple scanning method.

9. An image forming method, comprising the steps of:

(a) exposing the photothermographic imaging material of claim 1 with a light using an exposure apparatus; and then (b) subjecting the photothermographic imaging material to thermal development at a temperature of 80 to 200° C.

10. An image forming method, comprising the steps of:

(a) exposing the photothermographic imaging material of claim 1 with a laser beam using a laser scanning exposure apparatus; and then (b) subjecting the photothermographic imaging material to thermal development at a temperature of 80 to 200° C.

11. A photothermographic imaging material comprising a support having thereon a photosensitive layer comprising a photosensitive liver halide, a light-insensitive organic silver salt, a binder, a cross-linking agent having at least two isocyanate groups and a reducing agent for silver ions, wherein the photosensitive silver halide has an average particle size of 0.01 to 0.15 $\mu$m, and the photosensitive layer comprises a compound represented by Formula (A) or Formula (B):

Formula (A),

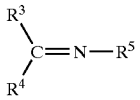

wherein each $R^3$, $R^4$ and $R^5$ is independently an alkyl group, an alkenyl group, an alkynyl group, an aryl group or a heterocyclic group, provided that $R^5$ includes a group represented by Formula ($\alpha$);

Formula ($\alpha$),

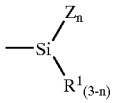

wherein Z is $OR^2$, X, or OH; n is an integer of 1 to 3; each $R^1$ and $R^2$ is independently an alkyl group, an alkenyl group, an alkynyl group, an aryl group or a heterocyclic group; and X is a chlorine atom or a bromine atom, Formula (B),

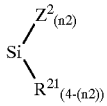

wherein $Z^2$ is $OR^{22}$, $X^2$, or OH; (n2) represents an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two groups selected from the group consisting of primary and secondary amino groups; and $X^2$ represents a chlorine atom or a bromine atom.

12. The photothermographic imaging material of claim 11, wherein the photosensitive silver halide has an average particle size of 0.03 to 0.10 $\mu$m.

13. A photothermographic imaging material comprising a support having thereon a photosensitive layer comprising a photosensitive silver halide, a light-insensitive organic silver salt, a reducing agent for silver ions, a cross-linking agent having at least two isocyanate groups and a binder, wherein the photosensitive layer comprises a compound represented by Formula (A) or Formula (B) and the photosensitive layer further comprises a compound represented by Formula (1):

Formula (A),

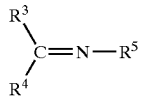

wherein each $R^3$, $R^4$ and, $R^5$ is independently an alkyl group, an alkenyl group, an alkynyl group, an aryl group or a heterocyclic group, provided that $R^5$ includes a group represented by Formula ($\alpha$):

Formula ($\alpha$),

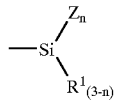

wherein Z represents $OR^2$, X, or OH; n is an integer of 1 to 3; each $R^1$ and $R^2$ is independently an alkyl group, an alkenyl group, an alkynyl group, an aryl group or a heterocyclic group; and X is a chlorine atom or a bromine atom, Formula (B),

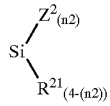

wherein $Z^2$ represents $OR^{22}$, $X^2$, or OH; (n2) is an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two groups selected from the group consisting of primary and secondary amino groups; and $X^2$ is a chlorine atom or a bromine atom Formula (1),

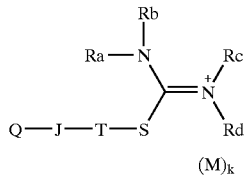

wherein Q represent an aryl group or an aromatic heterocyclic group; T represents a single bond or a bivalent aliphatic linking group; J represents a linking group containing at least one of O, S, and N; each Ra, Rb, Rc and Rd independently represents H, an acyl group, an aliphatic group, an aryl group or a heterocyclic group, provided that Ra and Rb, Rc and Rd, Ra and Rc, or Rb and Rd may combine to form a nitrogen containing heterocyclic group; M is an ion; and k is an integer necessary to neutralize a charge.

* * * * *

UNITED STATES PATENT AND TRADEMARK OFFICE

CERTIFICATE OF CORRECTION

PATENT NO. : 6,689,548 B2
DATED : February 10, 2004
INVENTOR(S) : Hirobumi Yamashita et al.

It is certified that error appears in the above-identified patent and that said Letters Patent is hereby corrected as shown below:

Column 45,
Line 10, after "ions" insert the following:

--wherein the photosensitive layer has a silver coverage of 0.8 to 2.5 g/m², and the photosensitive layer comprises a compound represented by Formula (A) or Formula (B):

Formula (A),

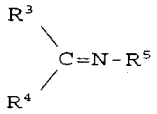

wherein each $R^3$, $R^4$ and $R^5$ is independently an alkyl group, an alkenyl group, an alkynyl group, an aryl group or a heterocyclic group, provided that $R^5$ includes a group represented by Formula (α):

Formula (α),

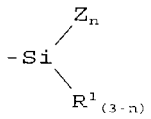

wherein Z represent $OR^2$, X or OH; n is an integer of 1 to 3; each $R^1$ and $R^2$ is independently an alkyl group, an alkenyl group, an alkynyl group, an aryl group or a heterocyclic group; and X is a chlorine atom or a bromine atom, Formula (B),

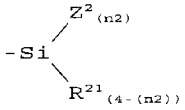

wherein $Z^2$ is $OR^{22}$, $X^2$, or OH; (n2) is an integer of 1 to 3; each $R^{21}$ and $R^{22}$ is independently an alkyl group, an alkenyl group, an alkynyl group, an aryl group or a heterocyclic group, provided that $R^{21}$ contains at least one primary amino group or at least two groups selected from the group consisting of primary and secondary amino groups; and $X^2$ is a chlorine atom or a bromine atom.--

UNITED STATES PATENT AND TRADEMARK OFFICE

CERTIFICATE OF CORRECTION

PATENT NO. : 6,689,548 B2
DATED : February 10, 2004
INVENTOR(S) : Hirobumi Yamashita et al.

It is certified that error appears in the above-identified patent and that said Letters Patent is hereby corrected as shown below:

Column 51,
Delete lines 64-66.

Column 52,
Delete lines 1-38.

Signed and Sealed this

Twenty-seventh Day of July, 2004

JON W. DUDAS
*Acting Director of the United States Patent and Trademark Office*